US009915234B2

(12) United States Patent
Ishitoya et al.

(10) Patent No.: US 9,915,234 B2
(45) Date of Patent: Mar. 13, 2018

(54) VALVE STRUCTURE AND FUEL SUPPLY DEVICE

(71) Applicants: KYOSAN DENKI CO., LTD., Koga, Ibaraki-pref. (JP); DENSO CORPORATION, Kariya, Aichi-pref. (JP)

(72) Inventors: Akihiro Ishitoya, Saitama (JP); Akinari Sugiyama, Koga (JP); Yutaka Niwa, Nagoya (JP)

(73) Assignee: KYOSAN DENKI CO., LTD., Koga (JP)

( * ) Notice: Subject to any disclaimer, the term of this patent is extended or adjusted under 35 U.S.C. 154(b) by 801 days.

(21) Appl. No.: 14/531,115

(22) Filed: Nov. 3, 2014

(65) Prior Publication Data

US 2015/0224873 A1 Aug. 13, 2015

(30) Foreign Application Priority Data

Feb. 7, 2014 (JP) ..... 2014-022599

(51) Int. Cl.
*F02M 37/04* (2006.01)
*F02M 37/10* (2006.01)
(Continued)

(52) U.S. Cl.
CPC ..... *F02M 37/106* (2013.01); *F02M 37/0023* (2013.01); *F02M 37/025* (2013.01); *F02M 2037/228* (2013.01); *Y10T 137/86212* (2015.04)

(58) Field of Classification Search
CPC ..... F02M 37/106; F02M 37/025; F02M 37/0023; F02M 2037/087
(Continued)

(56) References Cited

U.S. PATENT DOCUMENTS 5,218,942 A 6/1993 Coha et al.
5,993,180 A 11/1999 Westerhof et al.
(Continued)

FOREIGN PATENT DOCUMENTS

JP 4-34475 3/1992
JP 2012-62780 3/2012
(Continued)

OTHER PUBLICATIONS

Niwa, et al., U.S. Appl. No. 15/031,084, filed Apr. 21, 2016 (100 pages).
(Continued)

*Primary Examiner* — Marguerite McMahon
*Assistant Examiner* — James Kim
(74) *Attorney, Agent, or Firm* — Nixon & Vanderhye PC

(57) ABSTRACT

A valve structure includes a retention element, a first valve body, and a second valve body. The retention element is mounted to and is retained in a lower portion of a stored object. The stored object includes a pump device that pumps fuel from the fuel tank into the sub tank through a pumping passage that communicates an inside of the sub tank with an outside of the sub tank. The stored object is inserted from an upper portion of the sub tank and housed inside the sub tank. The first valve body is integrally formed with the retention element and extends from the retention element. The first valve body is located at a natural inlet open on the bottom portion of the sub tank. The second valve body is integrally formed with the retention element and extends from the retention element. The second valve body is located on the pumping passage.

23 Claims, 16 Drawing Sheets

(51) Int. Cl.
*F02M 37/02* (2006.01)
*F02M 37/00* (2006.01)
*F02M 37/22* (2006.01)

(58) Field of Classification Search
USPC ..... 123/509; 137/565.17
See application file for complete search history.

(56) References Cited

U.S. PATENT DOCUMENTS

| | | | | |
|---|---|---|---|---|
| 6,126,669 | A | 10/2000 | Rijken et al. | |
| 6,308,413 | B1 | 10/2001 | Westerhof et al. | |
| 6,312,436 | B1 | 11/2001 | Rijken et al. | |
| 8,511,340 | B2 | 8/2013 | Smid et al. | |
| 2002/0032964 | A1 | 3/2002 | Westerhof et al. | |
| 2005/0087178 | A1 | 4/2005 | Milton | |
| 2008/0196780 | A1* | 8/2008 | Tipton | B60K 15/077 137/861 |
| 2009/0090709 | A1* | 4/2009 | Shalomoff | B65D 11/1833 220/6 |
| 2009/0095264 | A1* | 4/2009 | Kawajiri | F02M 37/0041 123/506 |
| 2012/0118401 | A1* | 5/2012 | Murabayashi | B60K 15/077 137/123 |
| 2013/0233285 | A1* | 9/2013 | Yamada | F02M 25/00 123/514 |
| 2016/0245246 | A1 | 8/2016 | Niwa et al. | |
| 2016/0252059 | A1 | 9/2016 | Niwa et al. | |
| 2016/0252060 | A1 | 9/2016 | Niwa et al. | |
| 2016/0265494 | A1 | 9/2016 | Niwa et al. | |

FOREIGN PATENT DOCUMENTS

| | | |
|---|---|---|
| WO | WO 2015/068372 | 5/2015 |
| WO | WO 2015/068373 | 5/2015 |
| WO | WO 2015/068374 | 5/2015 |
| WO | WO 2015/068375 | 5/2015 |

OTHER PUBLICATIONS

Niwa, et al., U.S. Appl. No. 15/031,090, filed Apr. 21, 2016 (81 pages).

Niwa, et al., U.S. Appl. No. 15/031,136, filed Apr. 21, 2016 (97 pages).

Niwa, et al., U.S. Appl. No. 15/031,094, filed Apr. 21, 2016 (78 pages).

* cited by examiner

VALVE STRUCTURE AND FUEL SUPPLY DEVICE

CROSS REFERENCE TO RELATED APPLICATION

This application is based on and incorporates herein by reference Japanese Patent Application No. 2014-022599 filed on Feb. 7, 2014.

TECHNICAL FIELD

The present disclosure relates to a valve structure and a fuel supply device having the same.

BACKGROUND

Conventionally, a valve structure, which is located at a bottom portion of a sub tank arranged in a fuel tank, and allows an inflow of fuel into the sub tank while preventing an outflow of the fuel from the sub tank, is well known.

For example, in a valve structure disclosed in Patent Document 1 (U.S. Pat. No. 8,511,340), an umbrella valve is located on a pumping passage through which fuel pumped into a sub tank from a fuel tank by a jet pump flows. When the fuel is injected into the pumping passage by the jet pump, a negative pressure is generated and thus the umbrella valve is opened so that pumping of the fuel into the sub tank through the pumping passage is realized. On the other hand, when the fuel injection by the jet pump is stopped, the generation of the negative pressure is also stopped and thus the umbrella valve is closed so that fuel storage in the sub tank is realized.

Meanwhile, fuel for injection needs to be stored in the sub tank in order for the fuel to be pumped by the jet pump, for example, as disclosed in Patent Document 1. Accordingly, the present inventors have studied a technique in which a natural inlet is provided at a bottom portion of the sub tank and the umbrella valve as the valve structure is also located at the natural inlet at the bottom portion of the sub tank, in addition to the pumping passage.

However, since each umbrella valve is assembled at a plurality of positions at the bottom portion of the sub tank in the technique, the assembly work may be complicated and it may be difficult to check whether the assembly state is correct. That is, there is concern that the technique may cause deterioration in assembly workability due to an increase of the number of parts.

SUMMARY

The present disclosure has been made in view of the above-described points, and an object of the present disclosure is to achieve a reduction of the number of parts and an improvement of assembly workability for a valve structure which opens and closes each of a natural inlet and a pumping passage. In addition, another object of the present disclosure is to achieve a reduction of the number of parts and an improvement of assembly workability for a fuel supply device having a valve structure which opens and closes each of a natural inlet and a pumping passage.

In a first disclosure, a valve structure is located at a bottom portion of a sub tank that is arranged inside a fuel tank. The valve structure allows an inflow of fuel into the sub tank and prevents an outflow of the fuel from the sub tank. A valve structure includes a retention element, a first valve body, and a second valve body. The retention element is mounted to and is retained in a lower portion of a stored object. The stored object includes a pump device that pumps fuel from the fuel tank into the sub tank through a pumping passage that communicates an inside of the sub tank with an outside of the sub tank. The stored object is inserted from an upper portion of the sub tank and housed inside the sub tank. The first valve body is integrally formed with the retention element and extends from the retention element. The first valve body is located at a natural inlet open on the bottom portion of the sub tank. The second valve body is integrally formed with the retention element and extends from the retention element. The second valve body is located on the pumping passage.

According to the first disclosure, in the natural inlet which is open on the bottom portion of the sub tank in the fuel tank, the first valve body located at the natural inlet is opened, and thus an inflow of fuel into the sub tank is allowed. As a result, the fuel which naturally flows into the sub tank from the fuel tank through the natural inlet can be stored in the sub tank by closing the first valve body. On the other hand, in the pumping passage through which the fuel pumped by the pump device as the stored object housed inside the sub tank in the fuel tank flows, the second valve body located on the pumping passage is opened, and thus the inflow of the fuel into the sub tank is allowed. As a result, the fuel pumped from the fuel tank through the pumping passage into the sub tank by the pump device can be stored in the sub tank by closing the second valve body.

Since the first and second valve bodies individually exhibiting such basic functions extend from the common retention element and are integrally formed with the retention element, the number of parts of the valve structure which opens and closes each of the natural inlet and the pumping passage can be reduced. In the first disclosure, the stored object can be inserted from an upper portion of the sub tank and housed inside the sub tank, and the first and second valve bodies integrated with the retention element can be assembled to the lower portion of the stored object to be respectively located at the natural inlet and the pumping passage. Consequently, the valve structure can be easily assembled, and the assembly state of the valve structure can be easily optimized when the housed state of the stored object is checked from a position above the bottom portion in the sub tank. According to the valve structure, a reduction of the number of parts and an improvement of assembly workability can be accomplished.

In a second disclosure, a fuel supply device includes a sub tank, a stored object, and a valve structure. The sub tank is arranged inside a fuel tank. The stored object includes a pump device. The pump device pumps fuel from the fuel tank into the sub tank through a pumping passage that communicates an inside of the sub tank with an outside of the sub tank. The stored object is inserted from an upper portion of the sub tank and housed inside the sub tank. The valve structure is located at a bottom portion of the sub tank. The valve structure allows an inflow of the fuel into the sub tank and prevents an outflow of the fuel from the sub tank. The valve structure includes a retention element, a first valve body, a second valve body. The retention element is mounted to and is retained in a lower portion of the stored object. The first valve body is integrally formed with the retention element and extends from the retention element. The first valve body is located at a natural inlet that is open on the bottom portion of the sub tank. The second valve body is integrally formed with the retention element and extends from the retention element. The second valve body is located on the pumping passage.

According to the second disclosure, in the fuel supply device having the valve structure, a reduction of the number of parts and an improvement of assembly workability can be accomplished through the same principle as the above-mentioned first disclosure.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
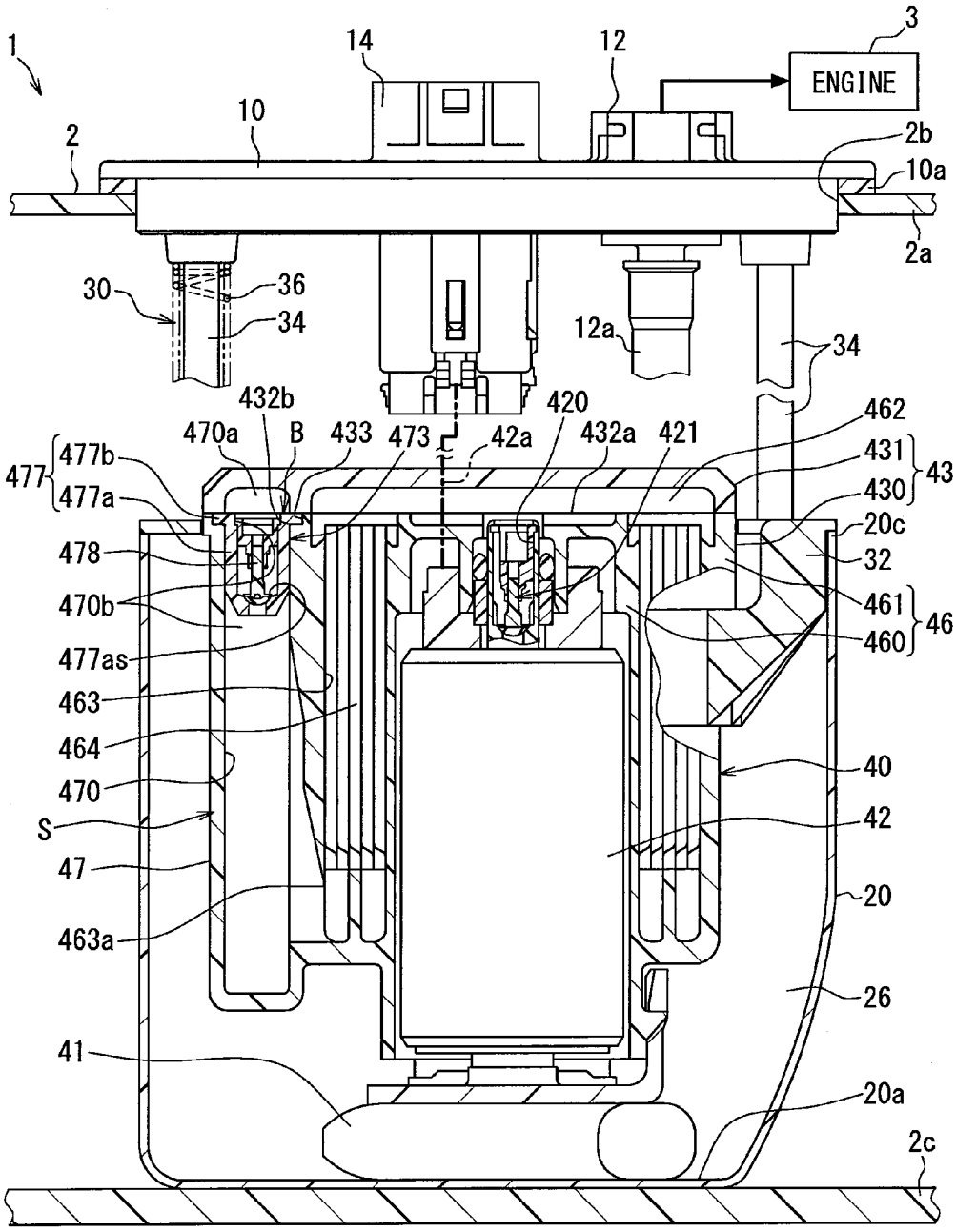
FIG. 1 is a cross-sectional view illustrating a fuel supply device according to a first embodiment and taken along line I-I in FIG. 3.

Hereinafter, a plurality of embodiments of the present disclosure will be described with reference to the accompanying drawings. In addition, like reference numerals refer to corresponding components in each embodiment, and redundant description thereof will be sometimes omitted.

When only a portion of a configuration is described in each embodiment, other configurations previously described in another embodiment can be applied to the other portion of the configuration. In addition, configurations specified in the description of each embodiment can be combined, and especially, configurations of the plurality of embodiments can be partially combined even though not specified herein so long as no problem occurs in the combination thereof.

First Embodiment

Figure 2:
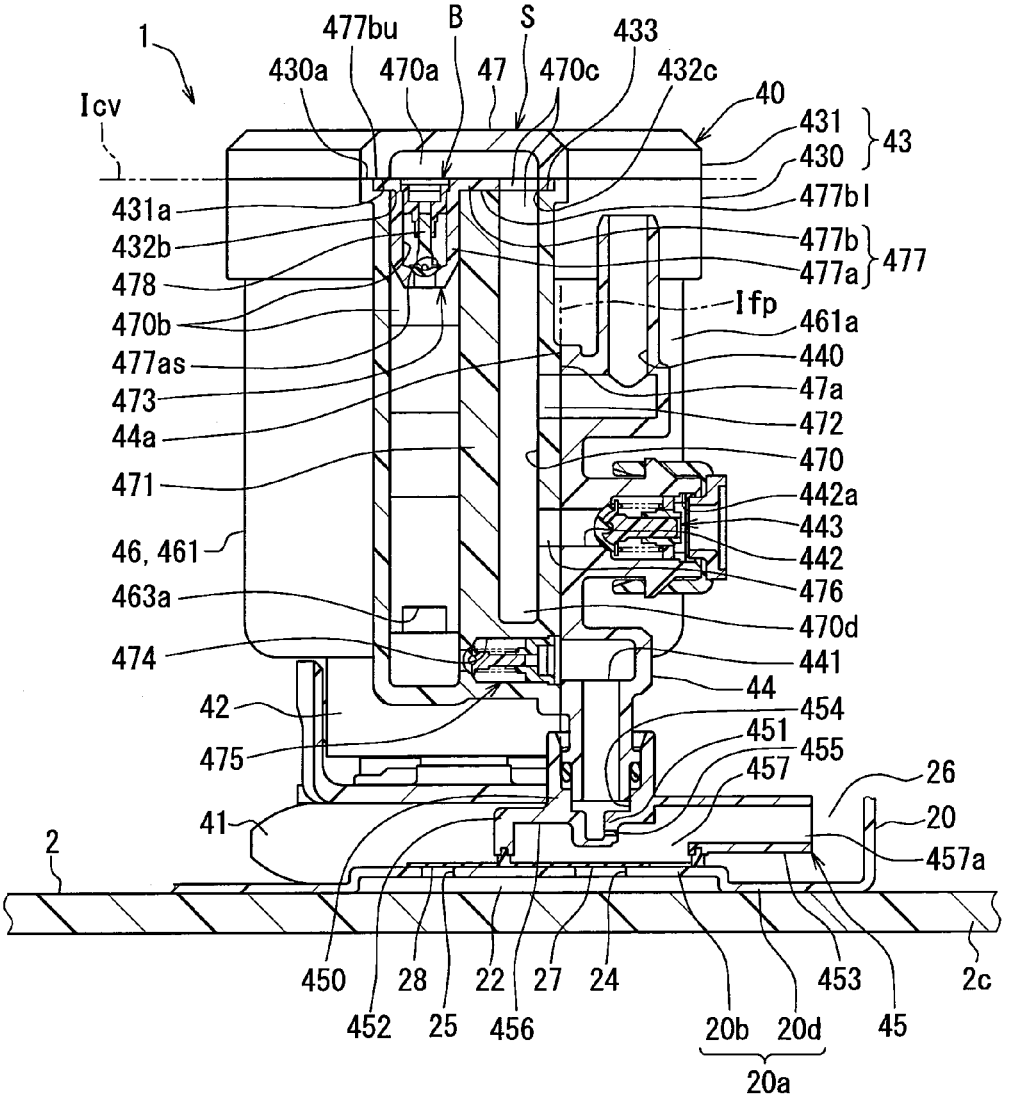
FIG. 2 is a cross-sectional view illustrating a pump unit in FIG. 1 and taken along line II-II in FIG. 3.

As shown in FIGS. 1 and 2, a fuel supply device 1 according to a first embodiment of the present disclosure is mounted on a fuel tank 2 of a vehicle. The device 1 directly supplies fuel in the fuel tank 2 to a fuel injection valve of an internal combustion engine 3 or indirectly supplies the fuel through a high-pressure pump or the like. Here, the fuel tank 2 equipped with the device 1 is made of resin or metal, has a hollow shape, and stores the fuel supplied to the internal combustion engine 3. In addition, the internal combustion engine 3 supplied with the fuel from the device 1 may be a gasoline engine or a diesel engine. In addition, a vertical direction of the device 1 shown in FIGS. 1 and 2 substantially coincides with a vertical direction of the vehicle on a horizontal plane.

(Configuration and Operation)

Hereinafter, a configuration and an operation of the device 1 will be described.

Figure 3:
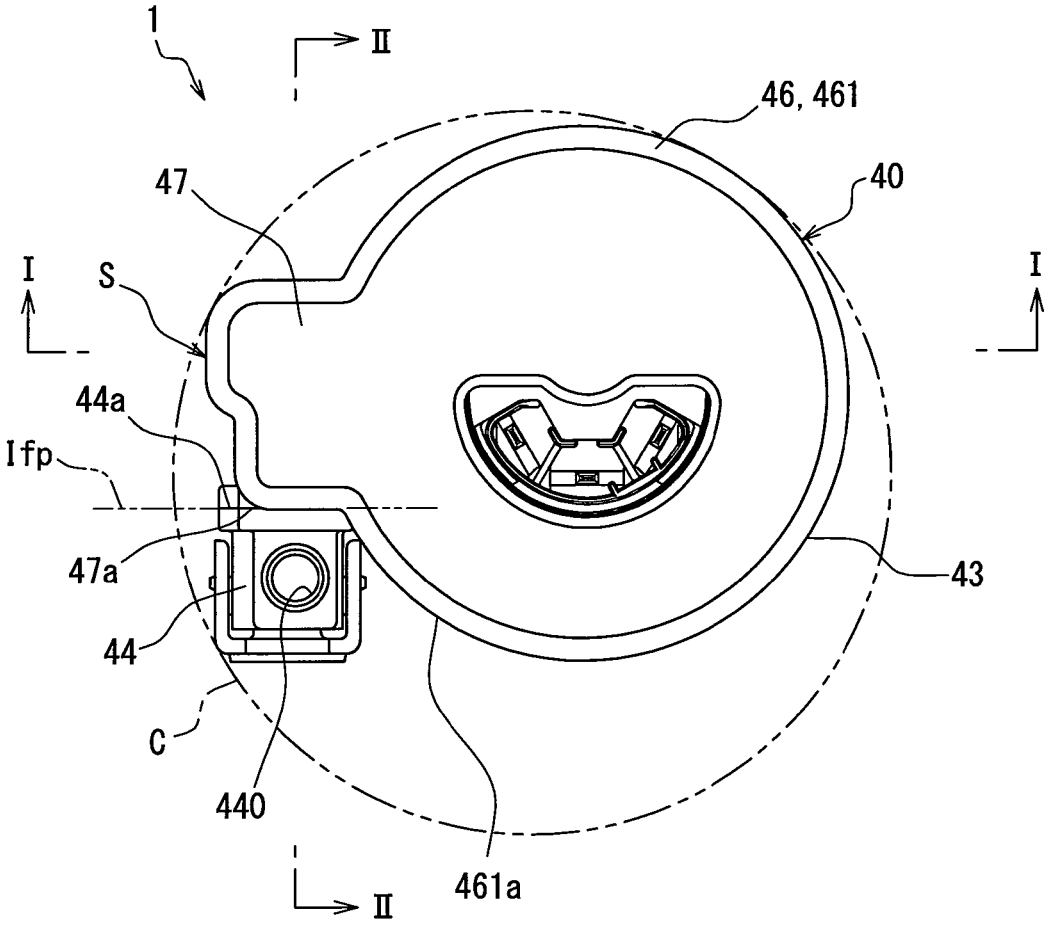
FIG. 3 is a plan view illustrating the pump unit in FIG. 1.

As shown in FIGS. 1 to 3, the device 1 includes a flange 10, a sub tank 20, an adjustment mechanism 30, and a pump unit 40.

As shown in FIG. 1, the flange 10 is made of resin, has a disc shape, and is mounted on a top plate portion 2*a* of the fuel tank 2. The flange 10 blocks a through-hole 2*b* formed on the top plate portion 2*a* by a packing 10*a* interposed between the flange 10 and the top plate portion 2*a*. The flange 10 integrally includes a fuel supply pipe 12 and an electrical connector 14.

The fuel supply pipe 12 protrudes in both upward and downward directions from the flange 10. The fuel supply pipe 12 communicates with the pump unit 40 through a bendable flexible tube 12*a*. Due to such a communication form, the fuel supply pipe 12 allows the fuel fed from the fuel tank 2 by a fuel pump 42 of the pump unit 40 to be supplied to the internal combustion engine 3 out of the fuel tank 2. The electrical connector 14 also protrudes in both upward and downward directions from the flange 10. The electrical connector 14 electrically connects the fuel pump 42 to an external circuit (not shown). Due to such electrical connection, the fuel pump 42 is controlled by the external circuit.

As shown in FIGS. 1 and 2, the sub tank 20 is made of resin, has a bottomed cylindrical shape, and is housed inside the fuel tank 2. A bottom portion 20*a* of the sub tank 20 is placed on a bottom portion 2*c* of the fuel tank 2. Here, as shown in FIG. 2, an inflow space 22 is defined between the bottom portion 2*c* and a recessed bottom portion 20*b*, which is recessed upward, of the bottom portion 20*a*. Furthermore, the recessed bottom portion 20*b* is formed with inlets 24 and 25. The inlets 24 and 25 are in communication with the fuel tank 2 through the inflow space 22. Through such a communication form, one inlet 24 allows the fuel transferred from the fuel tank 2 by a jet pump 45 of the pump unit 40 to flow into the sub tank 20. In addition, when the fuel is supplied to the empty fuel tank 2, the other inlet 25 allows the fuel supplied to the empty fuel tank 2 to flow into the sub tank 20. As such, the fuel flowing into the sub tank 20 through the inlets 24 and 25 is stored in an inner space 26 (see FIG. 1) of the sub tank 20 including the periphery of the fuel pump 42.

In addition, a reed valve 27 for opening the inlet 24 when a negative pressure from the jet pump 45 is applied thereto and a reed valve 28 for opening the inlet 25 when a fuel supply pressure is applied thereto, which are described in detail later, are provided on the recessed bottom portion 20*b* in the embodiment.

As shown in FIG. 1, the adjustment mechanism 30 includes a retention member 32, a pair of supports 34, an resilient member 36, etc.

The retention member 32 is made of resin, has an annular plate shape, and is mounted to an upper portion 20*c* of the sub tank 20 in the fuel tank 2. Each support 34 is made of metal, has a cylindrical shape, and is housed inside the fuel tank 2 and vertically extends. An upper end portion of each support 34 is fixed to the flange 10. Each support 34 is vertically and slidably guided by the retention member 32 in a state of entering the sub tank 20 beneath the upper end portion of the support 34.

The resilient member 36 is made of metal, has a coil spring shape, and is housed inside the fuel tank 2. The resilient member 36 is coaxially arranged around the corresponding support 34. The resilient member 36 is vertically interposed between the corresponding support 34 and the retention member 32. Due to such an interposition form, the resilient member 36 presses the bottom portion 20*a* of the sub tank 20 toward the bottom portion 2*c* of the fuel tank 2 through the retention member 32.

As shown in FIGS. 1 and 2, the pump unit 40 is housed in the fuel tank 2. The pump unit 40 includes a suction filter 41, a fuel pump 42, a filter case 43, a port member 44, a jet pump 45, etc.

The suction filter 41 is, for example, a nonwoven filter or the like, and is placed on the bottom portion 20*a* in the sub tank 20. The suction filter 41 filters the fuel sucked to the fuel pump 42 from the inner space 26 of the sub tank 20 so as to eliminate large pieces of foreign substances in the target fuel for suction.

The fuel pump 42 is arranged above the suction filter 41 in the sub tank 20. An axial direction of the fuel pump 42 having a cylindrical shape as a whole substantially coincides with the vertical direction. The fuel pump 42 is an electric pump in the embodiment. The fuel pump 42 is electrically connected to the electrical connector 14 through a bendable flexible wiring 42*a* as shown in FIG. 1. The fuel pump 42 operates in response to driving control from the external circuit through the electrical connector 14. Here, the fuel pump 42 in operation sucks the fuel stored around the same through the suction filter 41 and further regulates the pressure of the sucked fuel by pressurization thereof in the fuel pump 42.

The fuel pump 42 has a delivery valve 421 integrated with a delivery port 420 for delivering the fuel. The delivery valve 421 is a springless check valve in the embodiment. The delivery valve 421 is opened when the fuel is pressurized according to the operation of the fuel pump 42. When the delivery valve 421 is opened, the fuel is fed into the filter case 43 from the delivery port 420. On the other hand, the delivery valve 421 is closed when the pressurization of the fuel is stopped according to the stop of the fuel pump 42. When the delivery valve 421 is closed, feeding of the fuel into the filter case 43 is also stopped.

As shown in FIGS. 1 and 2, the filter case 43 is made of resin, has a hollow shape, and is vertically arranged over the inside and the outside of the sub tank 20. The filter case 43 is retained by the retention member 32 and thus positioned with respect to the sub tank 20.

A housing portion 46 of the filter case 43 has a double cylindrical shape configured of an inner cylindrical portion 460 and an outer cylindrical portion 461, and is coaxially arranged around the fuel pump 42. Due to such an arrangement form of the housing portion 46, an axial direction of the filter case 43 is along the vertical direction. As shown in FIG. 1, the housing portion 46 forms a communication chamber 462 which communicates with the delivery port 420 above the inner cylindrical portion 460 and the outer cylindrical portion 461 and is a space with a flat space. Furthermore, the housing portion 46 forms an housing chamber 463 which communicates with the communication chamber 462 between the inner cylindrical portion 460 and the outer cylindrical portion 461 and has a cylindrical hole shape. A fuel filter 464 having a cylindrical shape is housed inside the housing chamber 463. The fuel filter 464 is, for example, a honeycomb filter or the like, and filters the pressurized fuel delivered to the housing chamber 463 from the delivery port 420 through the communication chamber 462 so as to eliminate minute pieces of foreign substances in the pressurized fuel.

As shown in FIGS. 1 to 3, a protrusion portion 47 of the filter case 43 protrudes radially outward toward a circumferentially specific position S from the outer cylindrical portion 461. As shown in FIGS. 1 and 2, a fuel passage 470, a partition wall 471, a discharge passage 472, an outer residual pressure retention valve 473, a branch passage 474, an inner residual pressure retention valve 475, and a relief passage 476 are housed inside the protrusion portion 47. In other words, the protrusion portion 47 integrally includes the above-described components 470, 471, 472, 473, 474, 475, and 476 in a state in which the components are eccentric to the circumferentially specific position S.

The fuel passage 470 is a space formed by extension of the protrusion portion 47 in a reverse U-shape. The fuel passage 470 is partitioned by the partition wall 471 and is folded in the axial direction of the filter case 43 along the vertical direction. Particularly, the fuel passage 470 is linearly partitioned by the partition wall 471 having a flat belt shape. Through such a partition form, an upstream straight portion 470*b* and a downstream straight portion 470*c* extend downward from both ends of a folded portion 470*a* located at an uppermost side in the fuel passage 470, respectively, so as to have a straight cylindrical shape. That is, the fuel passage 470 is configured of the folded portion 470*a*, the upstream straight portion 470*b* located upstream of the folded portion 470*a*, and the downstream straight portion 470*c* located downstream of the folded portion 470*a*.

As shown in FIGS. 1 and 2, the upstream straight portion 470*b* communicates with a fuel outlet 463*a* of the housing chamber 463 in the fuel passage 470, and the fuel passage 470 is arranged downstream of the fuel filter 464. The fuel passage 470 having such an arrangement form allows the pressurized fuel, which is filtered by the fuel filter 464 and delivered from the fuel outlet 463*a*, to flow toward a lowermost downstream end 470*d* of the downstream straight portion 470*c*.

As shown in FIG. 2, the discharge passage 472 is formed in a cylindrical shape at an intermediate portion of the protrusion portion 47 in the vertical direction thereof. The discharge passage 472 branches from the downstream straight portion 470*c* located downstream of the fuel outlet 463*a* in the fuel passage 470 in a direction orthogonal to the axial direction of the filter case 43. The discharge passage 472 communicates with a discharge port 440 of the port member 44, thereby allowing the fuel flowing in the fuel passage 470 to be discharged to the internal combustion engine 3 through the flexible tube 12*a* and the fuel supply pipe 12 (see FIG. 1). As a result, the fuel passage 470 allows the fuel diverted from the flow toward the internal combustion engine 3 by the discharge passage 472 to flow downstream of the discharge passage 472.

The outer residual pressure retention valve 473 is provided downstream of the fuel outlet 463*a* in the upstream straight portion 470*b* located upstream of the discharge passage 472. That is, the outer residual pressure retention valve 473 is arranged midway from the fuel outlet 463*a* toward the discharge passage 472 in the fuel passage 470.

The outer residual pressure retention valve 473 is a springless check valve in the embodiment. The outer residual pressure retention valve 473 functions as one of "a plurality of on/off valves", in order to open and close the fuel passage 470 including the upstream straight portion 470*b*. The outer residual pressure retention valve 473 is opened when the pressurized fuel after filtration is delivered from the fuel outlet 463*a* according to the operation of the fuel pump 42. When the outer residual pressure retention valve 473 is opened, the pressurized fuel delivered to the fuel passage 470 flows toward the discharge passage 472 and the lowermost downstream end 470*d*. On the other hand, the outer residual pressure retention valve 473 is closed when the delivery of the fuel from the fuel outlet 463*a* is stopped according to the stop of the fuel pump 42. When the outer residual pressure retention valve 473 is closed, the flow of the fuel toward the discharge passage 472 and the lowermost downstream end 470*d* is also stopped. Therefore, the pressure of the fuel supplied to the internal combustion engine 3 from the discharge passage 472 by discharge thereof before the valve is closed is retained. That is, the residual pressure retention function is exhibited with respect to the fuel supplied to the internal combustion engine 3 through the fuel passage 470 by closing of the outer residual pressure retention valve 473. In addition, the retention pressure of the residual pressure retention function of the outer residual pressure retention valve 473 is a regulated pressure when the fuel pump 42 is stopped.

Through the above configuration, the fuel passage 470 has a form of leading to the internal combustion engine 3 via the outer residual pressure retention valve 473 and the discharge passage 472. In order to realize such a form, the fuel passage 470 is formed over the filter case 43 having a case body 430 and a case cap 431 and the outer residual pressure retention valve 473 having a valve housing 477 in the embodiment.

Specifically, the case body 430 is made of resin and is formed by integrally molding a bottomed-shaped section forming the housing chamber 463 of the housing portion 46 and a bottomed-shaped section forming the straight portions 470*b* and 470*c* of the protrusion portion 47, as shown in FIGS. 1 and 2. An upper portion of the case body 430 is formed with opening portions 432*a*, 432*b*, and 432*c* which are opened to a cylindrical hole shape, and a press-fit recessed portion 433 which is opened to a space with a flat space. Here, the housing opening portion 432*a* is formed at a position corresponding to the housing chamber 463. The upstream opening portion 432*b* is formed at a position corresponding to the upstream straight portion 470*b*. The downstream opening portion 432*c* is formed at a position corresponding to the downstream straight portion 470*c*. The press-fit recessed portion 433 is formed over the periphery of the upstream opening portion 432*b* and the periphery of the downstream opening portion 432*c*.

The case cap 431 is made of resin and is formed by integrally molding a recessed-shaped section forming the communication chamber 462 of the housing portion 46 and a recessed-shaped section forming the folded portion 470*a* of the protrusion portion 47. The case cap 431 is joined to the case body 430 by welding, and thus covers all of the opening portions 432*a*, 432*b*, and 432*c* of the case body 430. Here, both of an upper surface portion 430*a* of the case body 430 and a lower surface portion 431*a* of the case cap 431 have a planar shape, and are thus joined to each other on a common virtual plane Icv, as shown in FIG. 2. The virtual plane Icv of the embodiment is set to be perpendicular to the axial direction of the filter case 43 along the vertical direction, and thus an interface B on the virtual plane Icv is formed between the case body 430 inside the sub tank 20 and the case cap 431 outside the sub tank 20.

The valve housing 477 is made of resin and is formed by integrally molding a housing body 477*a* having a cylindrical shape and a joint plate 477*b* having a plate shape. The housing body 477*a* is fitted into the upstream opening portion 432*b*. Through such a fitting form, a portion of the upstream straight portion 470*b* vertically passes through the housing body 477*a*. The housing body 477*a* has a valve seat 477*as* which has a diameter decreasing toward the lower side thereof and is formed in a conical surface shape around the upstream straight portion 470*b*.

The joint plate 477*b* provided at an upper portion of the housing body 477*a* projects from the housing body 477*a* in a direction orthogonal to the axial direction of the filter case 43. The joint plate 477*b* is press-fitted into the press-fit recessed portion 433 around the opening portions 432*b* and 432*c*. Here, both of an upper surface portion 477*bu* and a lower surface portion 477*b*1 of the joint plate 477*b* have a planar shape, as shown in FIG. 2. Through such a shape, the upper surface portion 477*bu* is joined to an inner peripheral edge portion of the press-fit recessed portion 433 of the upper surface portion 430*a* of the case body 430 and the lower surface portion 431*a* of the case cap 431 by welding on the common virtual plane Icv. Through such press-fit and joining forms, a portion of the upstream straight portion 470*b* and a portion of the downstream straight portion 470*c* vertically pass through the joint plate 477*b* interposed between the case body 430 and the case cap 431.

The outer residual pressure retention valve 473 combines a valve element 478 as shown in FIGS. 1 and 2 with the valve housing 477 having the above configuration. The valve element 478 is made of a composite material of resin and rubber or a composite material of metal and rubber, has a cylindrical shape, and is coaxially housed inside the valve housing 477. Due to such a housing form, the valve element 478 is capable of being detachably seated to the valve seat 477*as* at a through-position of the upstream straight portion 470*b*. Accordingly, the outer residual pressure retention valve 473 is opened according to detachment of the valve element 478 from the valve seat 477*as* while being closed according to seating of the valve element 478 to the valve seat 477*as*.

Figure 4B:
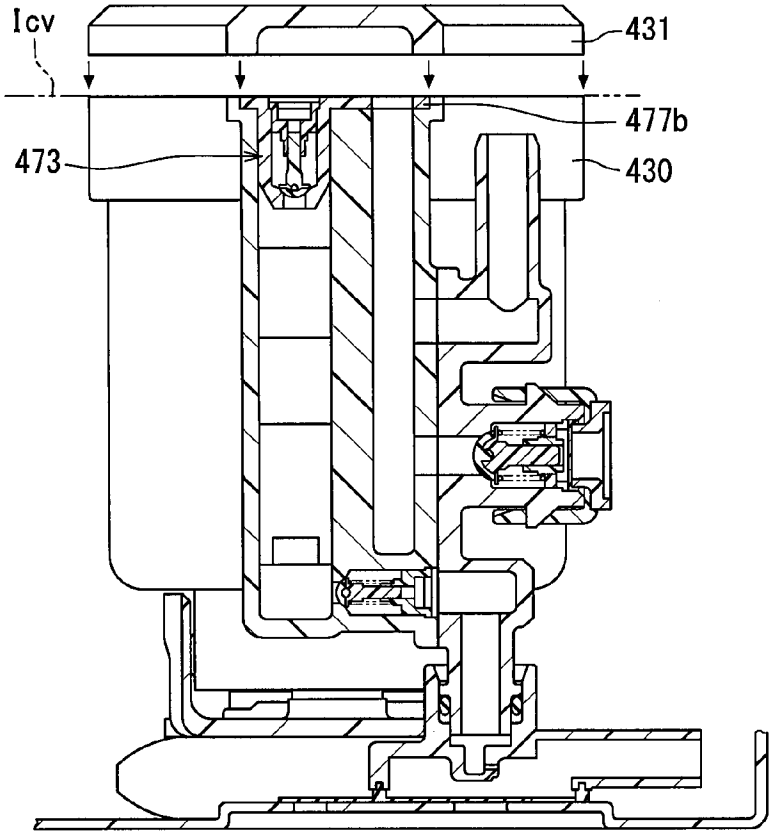
FIG. 4B is a schematic view for explaining a method of assembling a case cap to the case body.
Figure 4A:
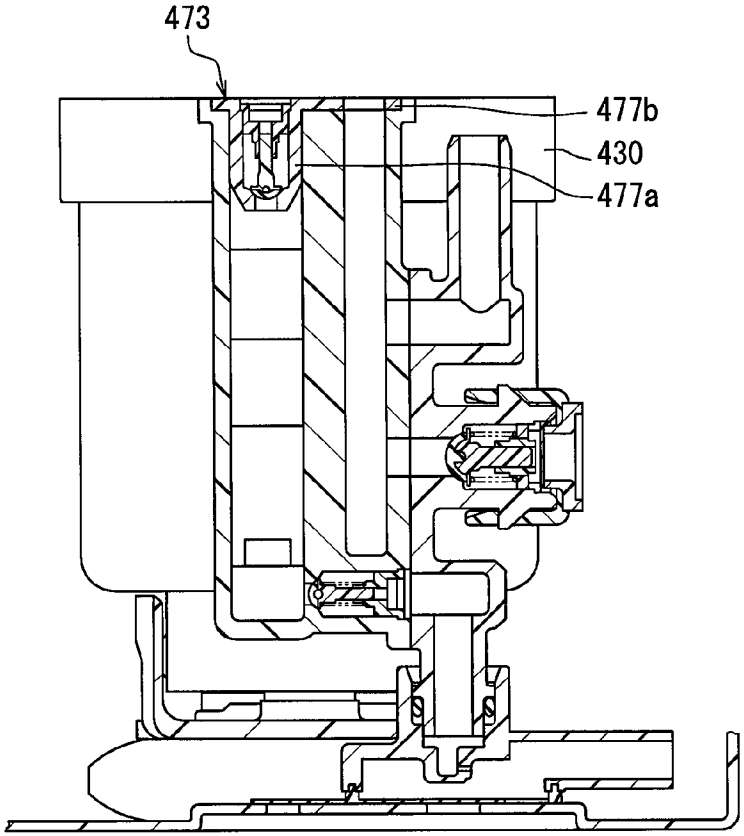
FIG. 4A is a schematic view illustrating a state in which a housing and a plate are attached to a case body in the first embodiment.

In the first embodiment, processes as shown in FIGS. 4A and 4B are sequentially performed in order to assemble the case cap 431 and the outer residual pressure retention valve 473 to the case body 430. First, the housing body 477*a* is fitted into the case body 430 and the joint plate 477*b* is press-fitted into the case body 430, as shown in FIG. 4A. Next, by overlapping and welding the case cap 431 to the case body 430 and the joint plate 477*b* on the common virtual plane Icv, the components 431, 430, and 477*b* are joined to each other, as shown in FIG. 4B. As a result, the outer residual pressure retention valve 473 is provided on the interface B between the case body 430 and the case cap 431 of the filter case 43, as shown in FIGS. 1 and 2.

As shown in FIG. 2, the branch passage 474 is formed in a stepped cylindrical hole shape at a lower end portion located beneath the discharge passage 472 and the lowermost downstream end 470*d* of the protrusion portion 47. The branch passage 474 branches from the upstream side of the outer residual pressure retention valve 473 in the upstream straight portion 470*b* in a direction orthogonal to the axial direction of the filter case 43. Particularly, the branch passage 474 of the first embodiment branches from the upstream straight portion 470*b* in the downward direction from the lowermost downstream end 470*d*, and thus does not intersect with the downstream straight portion 470*c*. The branch passage 474 communicates with a jet port 441 of the port member 44, and thus guides the fuel discharged from the fuel passage 470 through the inner residual pressure retention valve 475 to the jet pump 45.

The inner residual pressure retention valve 475 is provided on the branch passage 474. The inner residual pressure retention valve 475 is a spring-biased check valve in the embodiment. The inner residual pressure retention valve 475 functions as one of "a plurality of on/off valves", in order to open and close the fuel passage 470 leading to the branch passage 474. The inner residual pressure retention valve 475 is opened when the fuel having a set pressure or more is delivered from the fuel outlet 463*a* according to the operation of the fuel pump 42. When the inner residual pressure retention valve 475 is opened, the pressurized fuel diverted from the fuel passage 470 to the branch passage 474 flows toward the jet pump 45. On the other hand, the inner residual pressure retention valve 475 is closed when the pressure of the fuel delivered from the fuel outlet 463*a* by the operation of the fuel pump 42 is less than the set pressure or when the delivery is stopped according to the stop of the fuel pump 42. When the inner residual pressure retention valve 475 is closed, the flow of the fuel toward the jet pump 45 is also stopped. Therefore, when the flow of the fuel, particularly, accompanied by the stop of the fuel pump 42, the delivery valve 421 is also closed and thus the pressure of the fuel in the housing portion 46 is retained at the set pressure of the inner residual pressure retention valve 475. That is, the residual pressure retention function is exhibited with respect to the fuel at a housed position of the fuel filter 464 by closing of the inner residual pressure retention valve 475. In addition, the retention pressure of the residual pressure retention function of the inner residual pressure retention valve 475 is set to be, for example, 250 kPa.

The relief passage 476 is formed in a cylindrical hole shape at an intermediate portion located between the passages 472 and 474 of the protrusion portion 47 in the vertical direction thereof. The relief passage 476 branches from the downstream side of the discharge passage 472 in the downstream straight portion 470*c* in a direction orthogonal to the axial direction of the filter case 43. The relief passage 476 communicates with a relief port 442 of the port member 44, and thus guides the fuel diverted from the flow toward the internal combustion engine 3 in the filter case 43 to a relief valve 443.

The port member 44 is made of resin, has a hollow shape, and is arranged in the sub tank 20. As shown in FIGS. 2 and 3, the port member 44 is joined to the protrusion portion 47 at the specific position S by welding. Here, both of a side surface 44*a* of the port member 44 and a side surface 47*a* of the protrusion portion 47 have a planar shape, and are thus joined to each other on a common virtual plane Ifp. Since the virtual plane Ifp of the embodiment is set along the axial direction of the filter case 43, the port member 44 is joined in a posture of projecting from the protrusion portion 47 in a direction orthogonal to the axial direction.

In addition, the port member 44 of the embodiment projects in a direction tangential to a circular contour of an outer peripheral surface 461*a* with respect to the outer peripheral surface 461*a* of the outer cylindrical portion 461 which is bent to have a cylindrical surface shape as "a curved shape". In the embodiment with the above configuration, a projection amount of the port member 44 is set such that a circumscribed circle C in FIG. 3, which touches an outer circumference of the filter case 43 including an outer circumference of the protrusion portion 47 as an outer circumference at the specific position S and touches an outer circumference of the port member 44, has as small a diameter as possible.

As shown in FIGS. 2 and 3, the port member 44 integrally includes the discharge port 440, the jet port 441, the relief port 442, and the relief valve 443, in the outside of the filter case 43.

The discharge port 440 is an L-shaped space formed at an upper portion of the port member 44 in the vertical direction thereof. As shown in FIG. 2, the discharge port 440 communicates with the discharge passage 472 which is opened to the side surface 47*a* and communicates with the flexible tube 12*a* (see FIG. 1) at a side opposite to the communication position. Due to such a communication form, the discharge port 440 leads to the fuel passage 470 inside the filter case 43 through the discharge passage 472 and leads to the internal combustion engine 3 outside the filter case 43 through the flexible tube 12*a* and the fuel supply pipe 12. The discharge port 440, which functions as one of "a plurality of fuel ports" in such a way as to lead to the inside and the outside of the filter case 43, allows the fuel flowing from the fuel passage 470 to the discharge passage 472 to be discharged toward the internal combustion engine 3.

The jet port 441 is a reverse L-shaped space formed at a lower end portion located beneath the discharge port 440 of the port member 44. The jet port 441 communicates with the branch passage 474 which is opened to the side surface 47*a* and communicates with the jet pump 45 at a side opposite to the communication position. Due to such a communication form, the jet port 441 leads to the fuel passage 470 in the filter case 43 through the branch passage 474 and directly leads to the jet pump 45 in the outside of the filter case 43. The jet port 441, which functions as one of "a plurality of fuel ports" in such a way as to lead to the inside and the outside of the filter case 43, exhibits action of guiding the fuel discharged from the fuel passage 470 through the inner residual pressure retention valve 475 toward the jet pump 45.

The relief port 442 is formed in a stepped cylindrical hole shape at an intermediate portion located between the ports 440 and 441 of the port member 44 in the vertical direction thereof. The relief port 442 communicates with the relief passage 476 which is opened to the side surface 47*a* and communicates with the relief valve 443 at a side opposite to the communication position. Due to such a communication form, the relief port 442 leads to the fuel passage 470 in the filter case 43 through the relief passage 476 and directly leads to the relief valve 443 in the outside of the filter case 43. The relief port 442, which functions as one of "a plurality of fuel ports" in such a way as to lead to the inside and the outside of the filter case 43, exhibits action of guiding the fuel diverted from the flow to the internal combustion engine 3 in the fuel passage 470 toward the relief valve 443.

The relief valve 443 is provided on the relief port 442 and thus leads to the fuel passage 470 through the relief passage 476. Furthermore, the relief valve 443 communicates with the inner space 26 of the sub tank 20 through a lowermost downstream end 442*a* of the relief port 442, and thus enables the fuel guided to the relief passage 476 to be discharged to the inner space 26.

The relief valve 443 is a spring-biased check valve in the embodiment. The relief valve 443 opens and closes the fuel passage 470 leading to the relief port 442. The relief valve 443 is closed when the fuel having a pressure less than a relief pressure is guided in a state in which a normal state of a fuel supply passage leading to the internal combustion engine 3 from the fuel passage 470 is maintained, regardless of the operation and the stop of the fuel pump 42. The fuel, having a regulated pressure due to the operation of the fuel pump 42 when the relief valve 443 is closed, is discharged through the discharge passage 472 inside the filter case 43 and the discharge port 440 outside the filter case 43, and is thus fuel supplied to the internal combustion engine 3. On the other hand, the relief valve 443 is opened when the fuel having the relief pressure or more is guided due to generation of an abnormality in the fuel supply passage leading to the internal combustion engine 3 from the fuel passage 470, regardless of the operation and the stop of the fuel pump 42. When the relief valve 443 is opened, the fuel guided to the relief valve 443 is discharged to the inner space 26 of the sub tank 20. Therefore, the pressure of the fuel supplied to the internal combustion engine 3 is lost until reaching the relief pressure. That is, the relief function is exhibited with respect to the fuel supplied to the internal combustion engine 3 by opening of the relief valve 443. In addition, the relief pressure of the relief function of the relief valve 443 is set to be, for example, 650 kPa.

As shown in FIG. 2, the jet pump 45 is made of resin, has a hollow shape, and is arranged beneath the port member 44 in the sub tank 20. The jet pump 45 is placed on, particularly, the recessed bottom portion 20*b* of the bottom portion 20*a* of the sub tank 20. Due to such an arrangement form, the jet pump 45 and the port member 44 overlap the inlet 24 on the bottom portion 20*a* in the axial direction of the filter case 43. The jet pump 45 integrally includes a pressurization portion 450, a nozzle portion 451, a suction portion 452, and a diffuser portion 453.

The pressurization portion 450 forms a pressurization passage 454 which extends in the axial direction of the filter case 43 and has a stepped cylindrical hole shape. The pressurization passage 454 communicates with the jet port 441 beneath the port member 44. Through such a communication form, the pressurized fuel, which is discharged from the fuel passage 470 in the filter case 43 through the branch passage 474 in the filter case 43, is guided to the pressurization passage 454 via the jet port 441 outside the filter case 43.

The nozzle portion 451 forms a nozzle passage 455 which extends in a direction orthogonal to the axial direction of the filter case 43 and has a cylindrical hole shape. The nozzle passage 455 is located beneath the pressurization portion 450 to communicate with the pressurization passage 454. Furthermore, a passage area of the nozzle passage 455 is constricted more than that of the pressurization passage 454. Through such communication and constriction forms, the pressurized fuel guided to the pressurization passage 454 flows into the nozzle passage 455.

The suction portion 452 forms a suction passage 456 which extends in a direction orthogonal to the axial direction of the filter case 43 and has a hole shape. The suction passage 456 is located beneath the pressurization portion 450 and the nozzle portion 451 to communicate with the inlet 24. Through such a communication form, the fuel flowing into the sub tank 20 through the inlet 24 flows in the suction passage 456.

The diffuser portion 453 forms a diffuser passage 457 which extends in a direction orthogonal to the axial direction of the filter case 43 and has a cylindrical hole shape. The diffuser passage 457 is located beneath the pressurization portion 450 to communicate with the nozzle passage 455 and communicates with the inner space 26 of the sub tank 20 at a side opposite to the communication position. Furthermore, a passage area of the diffuser passage 457 is more enlarged than that of the nozzle passage 455. Through such communication and enlargement forms, the pressurized fuel flowing into the nozzle passage 455 is injected into the diffuser passage 457. Thus, when a negative pressure is generated around the injected flow, the fuel in the fuel tank 2 is sequentially sucked to the suction passage 456 and the diffuser passage 457 from the inlet 24. As such, the sucked fuel is fed in response to diffuser action in the diffuser passage 457, and is thus transferred to the inner space 26 including the periphery of the fuel pump 42.

In the embodiment, the diffuser passage 457 having a large diameter circular cross-section is upwardly eccentric from the nozzle passage 455 having a small diameter circular cross-section. With such a configuration, a lowermost downstream end 457*a*, which communicates with the inner space 26 in the diffuser passage 457 of the embodiment, is separated upward from a deepest bottom portion 20*d* surrounding the periphery of the recessed bottom portion 20*b* of the bottom portion 20*a* of the sub tank 20.

(Valve Structure and Peripheral Structure)

Figure 5:
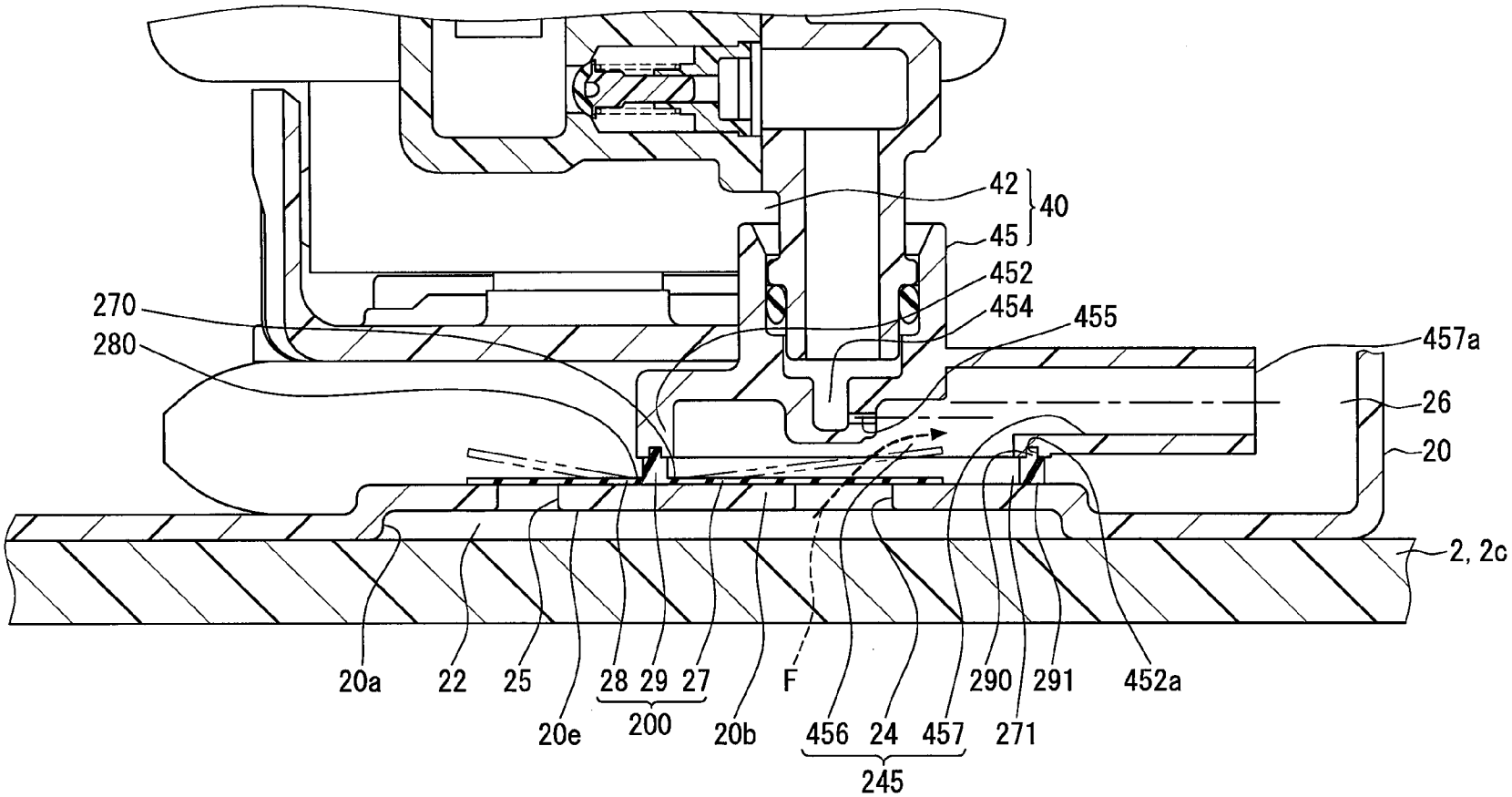
FIG. 5 is a cross-sectional view illustrating a valve structure and a peripheral structure thereof according to the first embodiment.

Next, as shown in FIG. 5, a valve structure 200 which is located at the bottom portion 20*a* of the sub tank 20 arranged in the fuel tank 2 and a peripheral structure of the valve structure 200 will be described in detail. The valve structure 200 includes a retention element 29 retained in the jet pump 45, together with the reed valve 28 as "a first valve body" and the reed valve 27 as "a second valve body", in a lower portion of the pump unit 40. In addition, the pump unit 40 is inserted from the upper portion 20*c* (see FIG. 1) of the sub tank 20 and housed inside the sub tank 20, and thus functions as "an stored object" including the jet pump 45 and the electric fuel pump 42.

Figure 6:
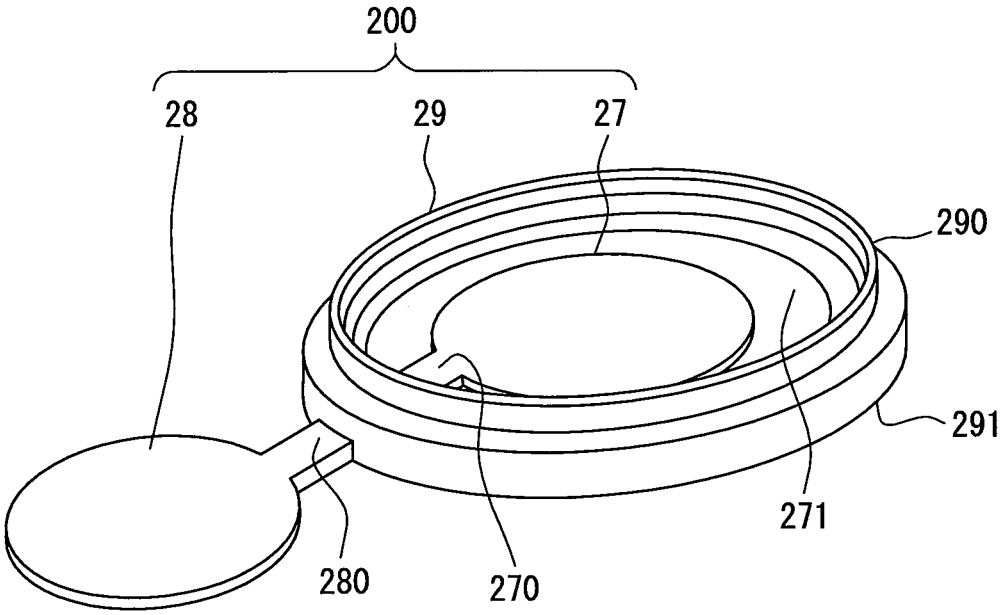
FIG. 6 is a perspective view illustrating the valve structure according to the first embodiment.

As shown in FIGS. 5 and 6, the retention element 29 is made of rubber and has an annular shape, so as to have elasticity as a whole. The retention element 29 has a mounting portion 290 which upwardly protrudes and is formed in a circumferentially continuous manner. As shown in FIG. 5, the cylindrical-shaped suction portion 452 covers the inlet 24 in the jet pump 45 and has a mounting groove 452*a* which is upwardly recessed and is formed in a circumferentially continuous manner. In the embodiment, the mounting portion 290 is press-fitted into the mounting groove 452*a* throughout the circumferential direction. Consequently, the retention element 29 is mounted to the jet pump 45 so as not to be movable relative to the jet pump 45, and is thus positioned and held.

The retention element 29 has a contact portion 291 which is formed in an annular planar shape at a side opposite to the mounting portion 290 in the vertical direction and is formed in a circumferentially continuous manner. The contact portion 291 comes into contact with the recessed bottom portion

20*b* of the bottom portion 20*a* of the sub tank 20 (hereinafter, referred to as "the sub tank bottom portion 20*a*") throughout the circumferential direction. Due to such contact, the retention element 29 is arranged between the suction portion 452 and the recessed bottom portion 20*b* so as to be elastically deformable, and thus seals a gap between the components 452 and 20*b* throughout the circumferential direction in a liquid-tight manner. Here, a contact position of the contact portion 291 on the recessed bottom portion 20*b* deviates from an outer periphery of the inlet 25 as "a natural inlet" while enclosing an outer periphery of the inlet 24 as "a pumping inlet" that is arranged adjacent to the inlet 25. Accordingly, the inlet 25 is fluidly isolated from the inlet 24 within the sub tank 20 by the seal function of the retention element 29 between the components 452 and 20*b*. In the embodiment, the nozzle passage 455 is arranged above the inlet 24.

As shown in FIGS. 5 and 6, the reed valve 28 is made of rubber, and is integrally formed with the retention element 29, and has a disc shape. The reed valve 28 is connected to one circumferential position of the retention element 29, and outwardly extends from an outer periphery of the retention element 29 so as to have a tongue shape. The reed valve 28 is located at the inlet 25 which is opened to both upper and lower sides of the recessed bottom portion 20*b* of the sub tank bottom portion 20*a* shown in FIG. 5.

As indicated by a solid line in FIG. 5, the reed valve 28 comes into contact with the recessed bottom portion 20*b* throughout the circumferential direction around the inlet 25, and is thus closed. In such a valve-closed state, the reed valve 28 blocks a whole upper opening of the inlet 25. On the other hand, as indicated by a two-dot line in FIG. 5, the reed valve 28 is separated from the recessed bottom portion 20*b* by swinging upward about a connection portion 280 (see FIG. 6) that is connected to the retention element 29, and is thus opened. In such a valve-opened state, the reed valve 28 opens the upper opening of the inlet 25 toward the inner space 26 of the sub tank 20 outside the jet pump 45.

Here, when the fuel is supplied to the empty fuel tank 2, the reed valve 28 is subjected to a fuel supply pressure from the fuel reaching the inlet 25 from the inflow space 22 in the fuel tank 2, and is thus opened to allow the inflow of the fuel from the inlet 25. As a result, the fuel naturally flows into the inner space 26 communicating with the inlet 25. Furthermore, when the natural inflow of the fuel is performed to a height at which the fuel is capable of being sucked by the fuel pump 42 of the inner space 26, the reed valve 28 is subjected to a higher head pressure than the fuel supply pressure from the introduced fuel, and is thus closed. As a result, the fuel is prevented from flowing out of the sub tank 20 through the inlet 25.

As shown in FIGS. 5 and 6, the reed valve 27 is made of rubber, and is integrally formed with the retention element 29 and the reed valve 28, and has a disc shape. The reed valve 27 is connected to the same one circumferential position as that of the reed valve 28 in the retention element 29, and inwardly extends from an inner periphery of the retention element 29 so as to have a tongue shape. The reed valve 27 is located at the inlet 24 which is opened to both upper and lower sides of the recessed bottom portion 20*b* of the sub tank bottom portion 20*a* as shown in FIG. 5. In arbitrary state, a gap 271 is maintained between the retention element 29 at an outer peripheral side and the reed valve 27. In the sub tank bottom portion 20*a* of the embodiment, with respect to the inlets 24 and 25 opened to an outer surface 20*e*, which is formed to have flat surface shape, of the recessed bottom portion 20*b*, positions of lower openings on the outer surface 20*e* substantially coincide with each other relative to the bottom portion 2*c* of the fuel tank 2.

As indicated by the solid line in FIG. 5, the reed valve 27 comes into contact with the recessed bottom portion 20*b* throughout the circumferential direction around the inlet 24, and is thus closed. In such a valve-closed state, the reed valve 27 blocks a whole upper opening of the inlet 24. On the other hand, as indicated by the two-dot line in FIG. 5, the reed valve 27 is separated from the recessed bottom portion 20*b* by upwardly swinging about a connection portion 270 (see FIG. 6) that is connected to the retention element 29, and is thus opened. In such a valve-opened state, the reed valve 27 opens the upper opening of the inlet 24 toward the suction passage 456 in the jet pump 45.

Here, in a state in which the fuel is stored to a level equal to or more than a height at which the fuel is capable of being sucked by the fuel pump 42 of the inner space 26, the fuel guided to the pressurization passage 454 is injected from the nozzle passage 455 into the diffuser passage 457 located downstream of the suction passage 456. The reed valve 27 is subjected to a negative pressure generated according to the fuel injection, and is thus opened to allow the inflow of the fuel from the inlet 24. As a result, the fuel sucked into the suction passage 456 at the downstream position from the inlet 24 by the negative pressure is pumped through the suction passage 456 by the diffuser passage 457, and is thus transferred to the inner space 26 from the lowermost downstream end 457*a*. In this case, the reed valve 27, in which the connection portion 270 to the retention element 29 is arranged at an upstream position in a flow direction F of the fuel flow generated toward the suction passage 456 from the inlet 24, opens the inlet 24 while maintaining an extending shape along the flow direction F. In addition, when the injection of the fuel from the nozzle passage 455 is stopped, the generation of the negative pressure at the diffuser passage 457 is also stopped. Therefore, the reed valve 27 is closed to prevent the fuel from flowing out of the sub tank 20 through the inlet 24.

As described above, the jet pump 45 as "a pump device" is capable of pumping the fuel from the fuel tank 2 to the sub tank 20 through the inlet 24 opened by the reed valve 27 and the passages 456 and 457. In the embodiment, the inlet 24 and the passages 456 and 457 are configured to form a pumping passage 245 that communicates an inside of the sub tank 20 with an outside of the sub tank 20, and the suction portion 452 as "a passage member" forms the suction passage 456 located downstream of the inlet 24 that serves as an upstream end of the pumping passage 245. In the embodiment with such a configuration, the fuel pumped by the jet pump 45 is supplied to the outside of the fuel tank 2 by the fuel pump 42 included in the pump unit 40 as "the stored object" described above.

Operation and Effects

Hereinafter, an operation and effects of the above-mentioned first embodiment will be described.

According to the first embodiment, in the inlet 25 which is open on the sub tank bottom portion 20*a* in the fuel tank 2, the tongue-shaped reed valve 28 located at the inlet 25 is opened, thereby allowing the fuel to flow into the sub tank 20. As a result, the fuel, which naturally flows into the sub tank 20 from the fuel tank 2 through the inlet 25, can be stored in the sub tank 20 by closing the reed valve 28. On the other hand, in the pumping passage 245 through which the fuel pumped by the jet pump 45 of the pump unit 40 housed in the sub tank 20 in the fuel tank 2 flows, the tongue-shaped reed valve 27 located on the pumping passage 245 is opened, thereby allowing the fuel to flow into the sub tank 20. As a result, the fuel, which is pumped into the sub tank 20 through the pumping passage 245 from the fuel tank 2 by the jet pump 45, can be stored in the sub tank 20 by closing the reed valve 27.

The reed valves 28 and 27 individually exhibiting the basic functions extend from the common retention element 29 and are integrally formed with the retention element 29. Accordingly, the number of parts of the valve structure 200, which opens and closes each of the inlet 25 and the pumping passage 245, can be reduced. In the first embodiment, the pump unit 40 can be inserted and housed inside the sub tank 20 from the upper portion 20*c* of the sub tank 20, and the reed valves 28 and 27 integrated with the retention element 29 can be assembled to the lower portion of the pump unit 40 so as to be respectively located at the inlet 25 and the pumping passage 245. Consequently, the valve structure 200 is easily assembled, for example, by automatic assembly or the like. In addition, the assembly state of the valve structure 200 can be easily optimized when the housed state of the pump unit 40 is checked from a position above the bottom portion 20*a* in the sub tank 20. According to the valve structure 200 and the fuel supply device 1 having the same, the reduction of the number of parts and the improvement of assembly workability can be accomplished.

According to the first embodiment, the annular retention element 29 comes into contact with the sub tank bottom portion 20*a* and encloses the outer periphery of the inlet 24 of the pumping passage 245, thereby enabling the reed valve 27 extending inwardly from the inner periphery of the retention element 29 to be accurately located at the inlet 24. According to the first element, the annular retention element 29 comes into contact with the sub tank bottom portion 20*a* and encloses the outer periphery of the inlet 24, thereby enabling the reed valve 28 extending outwardly from the outer periphery of the retention element 29 to be accurately located at the inlet 25 arranged adjacent to the inlet 24. Thereby, it is possible to avoid such a situation in which the basic function of the valve structure 200 for preventing the outflow of the fuel from the sub tank 20 is damaged due to position deviation of the reed valves 28 and 27.

In the first embodiment, the gap between the sub tank bottom portion 20*a* and the suction portion 452 serving as the lower portion of the pump unit 40 is sealed by the retention element 29 arranged therebetween. Here, the annular retention element 29 in which the reed valve 27 extends inwardly from the inner periphery thereof comes into contact with the sub tank bottom portion 20*a* and encloses the outer periphery of the inlet 24, thereby enabling the seal function of the pumping passage 245 to be exhibited throughout the circumferential direction when the valve is opened. In addition, the annular retention element 29 in which the reed valve 28 extends outwardly from the outer periphery thereof can fluidly isolate the inlet 25 from the inlet 24, which are arranged adjacent to each other in the sub tank bottom portion 20*a*, inside the sub tank 20 by the above seal function. Thereby, the deterioration in pumping efficiency due to the fuel suction into the pumping passage 245 can be avoided.

In the first embodiment, the gap between the sub tank bottom portion 20*a* formed with the inlet 24 at the upstream end of the pumping passage 245 and the suction portion 452 serving as the portion of the pumping passage 245 downstream of the inlet 24 is sealed by the retention element 29 arranged therebetween. Consequently, the suction of the fuel into the pumping passage 245 from the gap between the bottom portion 20*a* and the suction portion 452 in the sub tank 20 when the reed valve 27 located at the inlet 24 is opened can be suppressed using the retention element 29. Particularly, according to the first embodiment, in the outer peripheral side of the inlet 24 that is covered by the suction portion 452, the suction of the fuel into the pumping passage 245 from the gap between the bottom portion 20*a* and the suction portion 452 can be suppressed by opening the reed valve 27 at the inlet 24. Thereby, the deterioration in pumping efficiency through the pumping passage 245 can be avoided while the number of parts is reduced.

According to the first embodiment, the annular retention element 29 in which the reed valve 27 extends inwardly from the inner periphery thereof comes into contact with the sub tank bottom portion 20*a* at the outer position around the inlet 24, thereby enabling the seal function of the pumping passage 245 to be exhibited throughout the circumferential direction when the valve is opened. Thereby, the deterioration in pumping efficiency due to the suction of the fuel into the pumping passage 245 can be avoided.

In the first embodiment, the retention element 29 that is made of rubber and is integrally formed with the reed valves 28 and 27, which contributes to the reduction of the number of parts, can further exhibit a vibration transfer suppression function as well as the seal function between the sub tank bottom portion 20*a* and the suction portion 452. According to the vibration transfer suppression function, since it is difficult for vibration generated by the jet pump 45 to be transferred to the sub tank bottom portion 20*a* through the suction portion 452 of the jet pump 45, the generation of abnormal noise caused by the above-described transfer can be avoided.

According to the first embodiment, the retention element 29 which is press-fitted into the lower portion of the pump unit 40 can have high strength mounting to the lower portion. Thereby, the deterioration in assembly workability caused by detachment of the retention element 29 from the lower portion of the pump unit 40 when the valve structure 200 is assembled by housing the pump unit 40 inside the sub tank 20 from the upper portion 20*c* of the sub tank 20 can be avoided. With such a configuration, since the retention element 29 is positioned by being press-fitted into the lower portion of the pump unit 40, the position deviation of the reed valves 28 and 27 from the respective inlets 25 and 24 can be suppressed. Thereby, it is possible to avoid such a situation in which the basic function of the valve structure 200 for preventing the outflow of the fuel from the sub tank 20 is damaged by the position deviation of the reed valves 28 and 27.

In the first embodiment, the reed valve 27 in which the connection portion 270 to the retention element 29 is arranged at an upstream position in the flow direction F of the fuel in the pumping passage 245 extends along the flow direction F, thereby enabling the valve to be suppressed from warping upward when the valve is opened. Thereby, since the flow resistance of the fuel generated by the reed valve 27 is decreased, the deterioration in pumping efficiency due to the flow resistance can be avoided while the basic function of the reed valve 27 for allowing the inflow of the fuel into the sub tank 20 and preventing the outflow of the fuel from the sub tank 20 is maintained.

According to the first embodiment, the plate-shaped reed valves 28 and 27 swing about the respective connection portions 280 and 270 that are connected to the retention element 29, thereby enabling the inlets 25 and 24 to be separately opened and closed. Consequently, the basic function for allowing the inflow of the fuel into the sub tank 20 and preventing the outflow of the fuel from the sub tank 20 can be reliably exhibited with respect to the respective inlets 25 and 24 by the reed valves 28 and 27 having the above-described simple swing structure.

According to the first embodiment, in the pumping passage 245 in which the fuel flow is generated by the fuel injection by means of the jet pump 45, the opening and closing of the reed valve 27 can be controlled using the negative pressure generated according to the fuel injection. Thereby, the pumping of the fuel by allowing the inflow of the fuel into the sub tank 20 and the storage of the fuel by preventing the outflow of the fuel from the sub tank 20 can be reliably exhibited as the basic function of the reed valve 27.

In the pumping passage 245 of the first embodiment, when the negative pressure is generated in the diffuser passage 457 at the lowermost downstream side according to the fuel injection from the nozzle passage 455, the fuel is sucked into the suction passage 456 at the downstream side from the inlet 24 at the upstream end that is opened by the reed valve 27, and the fuel is pumped into the sub tank 20. In this case, the injection flow of the fuel from the nozzle passage 455 is upwardly inclined by the fuel flow that flows toward the diffuser passage 457 through the lower suction passage 456. However, in the diffuser passage 457 of the first embodiment which is upwardly eccentric from the nozzle passage 455, the inclined injection flow of the fuel is forced to flow toward the central position of the diffuser passage 457, thereby enabling the pumping efficiency to be increased. In addition, the lowermost downstream end 457*a* of the diffuser passage 457 is separated upward from the deepest bottom portion 20*d* of the sub tank bottom portion 20*a*. Accordingly, water collected in the deepest bottom portion 20*d* can be suppressed from infiltrating into the diffuser passage 457 when the vehicle tilts or turns.

The electric fuel pump 42 of the first embodiment can supply the fuel, which flows into and is stored inside the sub tank 20 from the inlet 24 and the pumping passage 245, to the outside of the fuel tank 2 by the basic functions of the reed valves 28 and 27. The fuel pump 42 can be assembled at a correct position together with the valve structure 200 by housing the pump unit 40 including the fuel pump 42 inside the sub tank 20 from the upper portion 20*c* of the sub tank 20. Thereby, the assembly workability can be improved.

Second Embodiment

Figure 7:
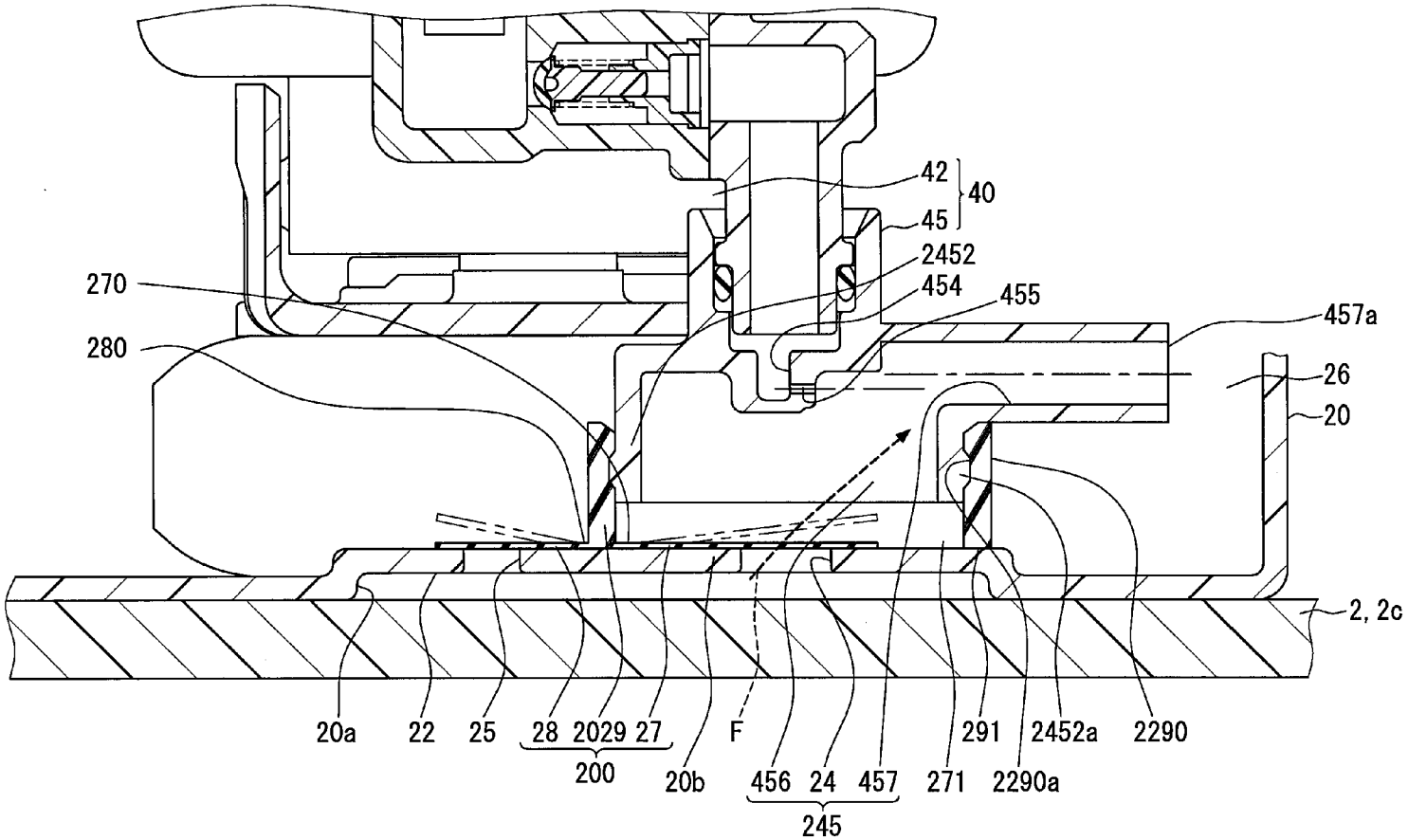
FIG. 7 is a cross-sectional view illustrating a valve structure and a peripheral structure thereof according to a second embodiment.

A second embodiment of the present disclosure shown in FIG. 7 is a modification example of the first embodiment. In the second embodiment, a retention element 2029 with an annular shape has a mounting portion 2290 into which a suction portion 2452 having a cylindrical shape is press-fitted from an upper side, and the mounting portion 2290 is formed in a circumferentially continuous manner. The mounting portion 2290 has a mounting recess 2290*a* which is recessed from an inner periphery thereof and has an annular recessed groove shape. In addition, the suction portion 2452 of the second embodiment has a mounting protrusion strip 2452*a* which outwardly protrudes from an outer periphery thereof and has an annular protrusion shape corresponding to the mounting recess 2290*a*, in place of the mounting groove 452*a* as described in the first embodiment. In addition, a configuration of the suction portion 2452 is substantially identical to that of the suction portion 452 described in the first embodiment, except for having the mounting protrusion strip 2452*a*.

Through such a configuration, in the retention element 2029, the mounting protrusion strip 2452*a* is fitted into the mounting recess 2290*a* so that the suction portion 2452 in the press-fitting state is covered by the mounting portion 2290 throughout the circumferential direction thereof. Also in the second embodiment, the retention element 2029 is mounted to a jet pump 45 so as not to be movable relative to the jet pump 45, and is thus positioned and held. According to the second embodiment, the retention element 2029 into which a lower portion of a pump unit 40 is press-fitted, instead of being press-fitted into the lower portion of the pump unit 40, can have high strength mounting to the lower portion. Accordingly, effects including the high mounting strength can be exhibited similarly to the effects described in the first embodiment.

Third Embodiment

Figure 8:
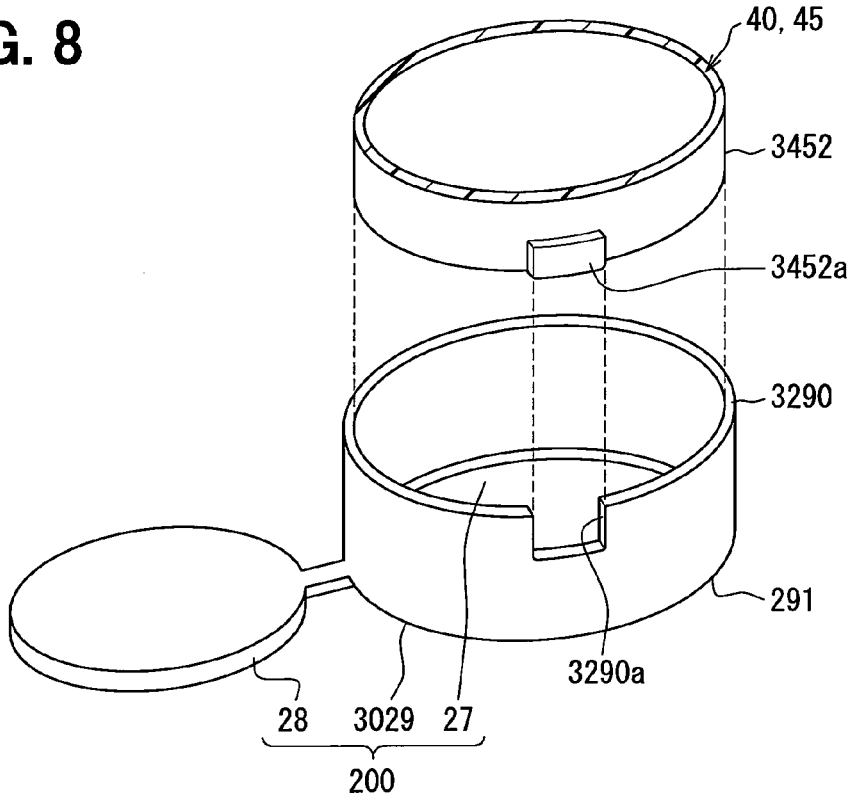
FIG. 8 is a perspective view illustrating a valve structure and a peripheral structure thereof according to a third embodiment.

A third embodiment of the present disclosure shown in FIG. 8 is a modification example of the second embodiment. In the third embodiment, a mounting portion 3290 into which a suction portion 3452 having a cylindrical shape is press-fitted has a mounting slit 3290*a* which penetrates between inner and outer peripheral surfaces of the mounting portion 3290 and is formed at one circumferential position thereof, in place of the mounting recess 2290*a* of the second embodiment. In addition, the suction portion 3452 of the third embodiment has a mounting protrusion piece 3452*a* which outwardly protrudes from an outer periphery of the suction portion 3452 and is formed at one circumferential position thereof, in place of the mounting protrusion strip 2452*a* of the second embodiment. In addition, a configuration of the suction portion 3452 is substantially identical to that of the suction portion 452 described in the first embodiment, except for having the mounting protrusion piece 3452*a*.

Through such a configuration, in a retention element 3029 including the mounting portion 3290 having the mounting slit 3290*a*, the mounting slit 3290*a* is engaged by the mounting protrusion piece 3452*a* so that the suction portion 3452 in the press-fitted state is covered by the mounting portion 3290 throughout the circumferential direction thereof. Also in the third embodiment, the retention element 3029 is mounted to a jet pump 45 so as not to be movable relative to the jet pump 45, and is thus positioned and held. According to the third embodiment, the same effects as those described in the first embodiment can be exhibited according to the second embodiment.

According to the third embodiment, the mounting slit 3290*a* as "a rotation stopper" is engaged to the mounting protrusion piece 3452*a* of the suction portion 3452 so that rotation of the retention element 3029 is regulated. Consequently, the reed valves 28 and 27 can be suppressed from deviating from the respective inlets 25 and 24 due to the rotation of the retention element 3029. Thereby, it is possible to avoid such a situation in which a basic function of a valve structure 200 for preventing an outflow of fuel from a sub tank 20 is damaged.

Fourth Embodiment

Figure 9:
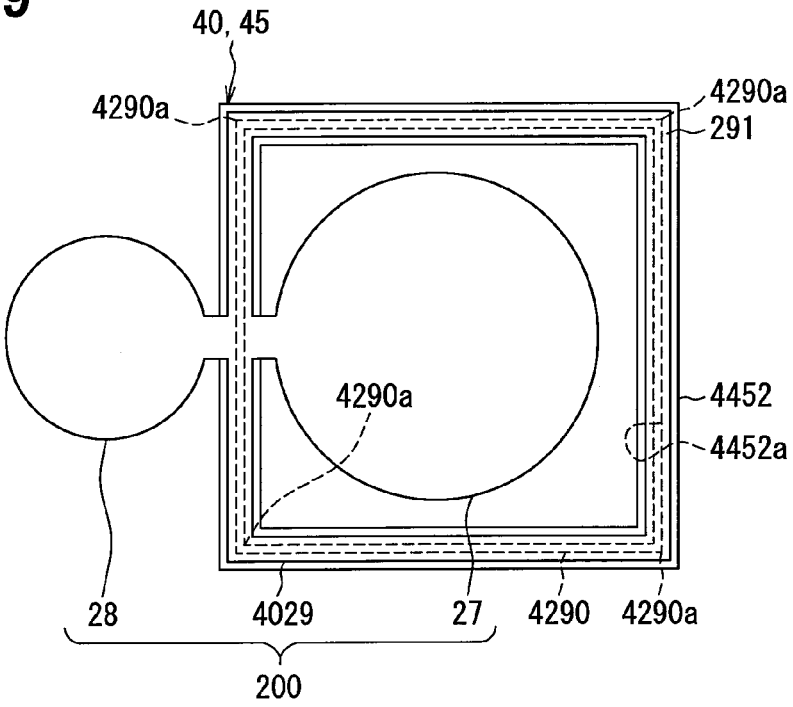
FIG. 9 is a bottom view illustrating a valve structure and a peripheral structure thereof according to a fourth embodiment.

A fourth embodiment of the present disclosure shown in FIG. 9 is a modification example of the first embodiment. In the fourth embodiment, a retention element 4029 having a rectangular annular shape has a mounting portion 4290 which upwardly protrudes and is formed along four sides of the rectangular shape. In the fourth embodiment, a suction portion 4452 having a rectangular cylindrical shape has a mounting groove 4452*a* which is upwardly recessed and is formed along four sides of the rectangular shape. In addition, a configuration of the suction portion 4452 is substantially identical to that of the suction portion 452 described in the first embodiment, except for having the mounting groove 4452*a*.

Through such a configuration, the mounting portion 4290 coincides with each side of the rectangular shape and is press-fitted into the mounting groove 4452*a* so that the retention element 4029 is mounted to a jet pump 45 so as not to be movable relative to the jet pump 45 and is thus positioned and held. Accordingly, also in the fourth embodiment, the same effects as those described in the first embodiment can be exhibited.

According to the fourth embodiment, four corner parts 4290*a* of the mounting portion 4290 shown in FIG. 9 are engaged by the mounting groove 4452*a* of the suction portion 4452, as "a rotation stopper", so that rotation of the retention element 4029 is regulated. Consequently, the reed valves 28 and 27 can be suppressed from deviating from the respective inlets 25 and 24 due to the rotation of the retention element 4029. Thereby, it is possible to avoid such a situation in which the basic function of the valve structure 200 for preventing the outflow of the fuel from the sub tank 20 being damaged by the position deviation of the reed valves 28 and 27.

Fifth Embodiment

Figure 10:
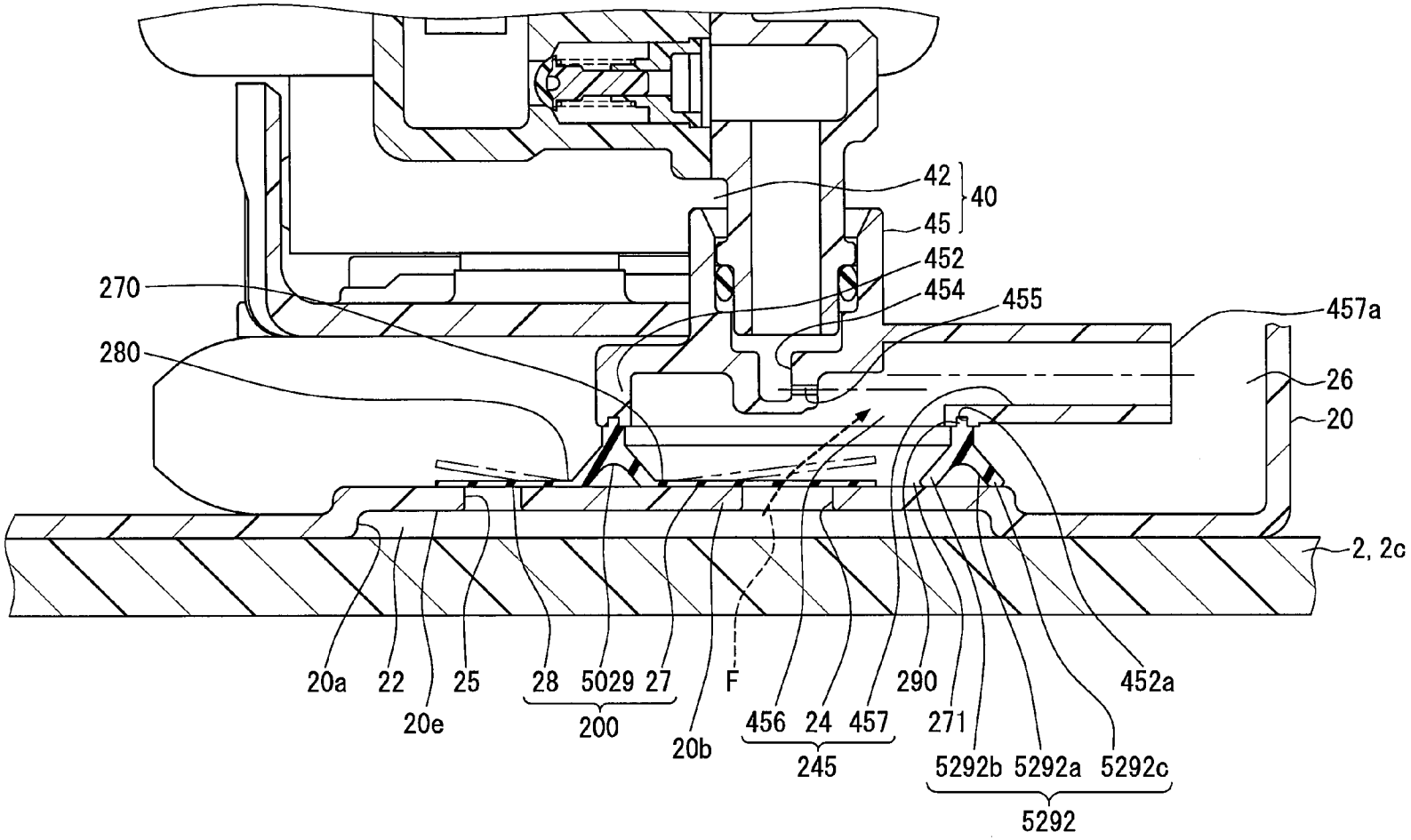
FIG. 10 is a cross-sectional view illustrating a valve structure and a peripheral structure thereof according to a fifth embodiment.

A fifth embodiment of the present disclosure shown in FIG. 10 is a modification example of the first embodiment. In the fifth embodiment, a retention element 5029 having an annular shape has a leg portion 5292 formed in a circumferentially continuous manner, in place of the contact portion 291. The leg portion 5292 is divided so as to have a two-pronged shape by a reverse V-shaped recessed groove 5292*a* which is open toward a recessed bottom portion 20*b* of a sub tank bottom portion 20*a*. One division part 5292*b* of the leg portion 5292 is inwardly inclined with respect to the vertical direction toward the recessed bottom portion 20*b*. The other division part 5292*c* of the leg portion 5292 is outwardly inclined with respect to the vertical direction toward the recessed bottom portion 20*b*. Each of the division parts 5292*b* and 5292*c* comes into contact with the recessed bottom portion 20*b* throughout the circumferential direction.

Through such a configuration, the retention element 5029 is arranged between the suction portion 452 and the recessed bottom portion 20*b* and is elastically deformable, and thus seals a gap between the components 452 and 20*b* throughout the circumferential direction in a liquid-tight manner. Here, a contact position of each of the division parts 5292*b* and 5292*c* on the recessed bottom portion 20*b* outwardly deviates from an inlet 25 while enclosing an outer periphery of an inlet 24. Accordingly, also in the fifth embodiment, the same effects as those described in the first embodiment can be exhibited.

According to the fifth embodiment, the leg portion 5292 of the retention element 5029 mounted to the suction portion 452 by a mounting portion 290 comes into contact with a sub tank bottom portion 20*a* to be elastically deformed, and thus can reliably absorb a clearance on the contact interface. Thereby, a seal function of the retention element 5029 between the sub tank bottom portion 20*a* and the suction portion 452, and reliability of deterioration avoidance effect of pumping efficiency can be enhanced. According to the elastic deformation of the leg portion 5292 between the sub tank bottom portion 20*a* and the suction portion 452, a vibration transfer suppression function can be exhibited. According to the vibration transfer suppression function, since it is difficult for vibration generated by a jet pump 45 to be transferred to the sub tank bottom portion 20*a* through the suction portion 452 of the jet pump 45, generation of abnormal noise caused by the above transfer can be avoided.

In the retention element 5029 of the fifth embodiment, since the leg portion 5292 divided to have the two-pronged shape by the recessed groove 5292*a* is easily elastically deformed, the seal function and the vibration transfer suppression function can be increased together between the sub tank bottom portion 20*a* and the suction portion 452. Thereby, all of the deterioration avoidance effect of pumping efficiency and the generation avoidance effect of abnormal noise can have high reliability. Since each of the division parts 5292*b* and 5292*c* of the leg portion 5292 is inclined toward the sub tank bottom portion 20*a*, a load of the retention element 5029 is decreased with respect to movement of the jet pump 45 in the transverse direction.

Sixth Embodiment

Figure 11:
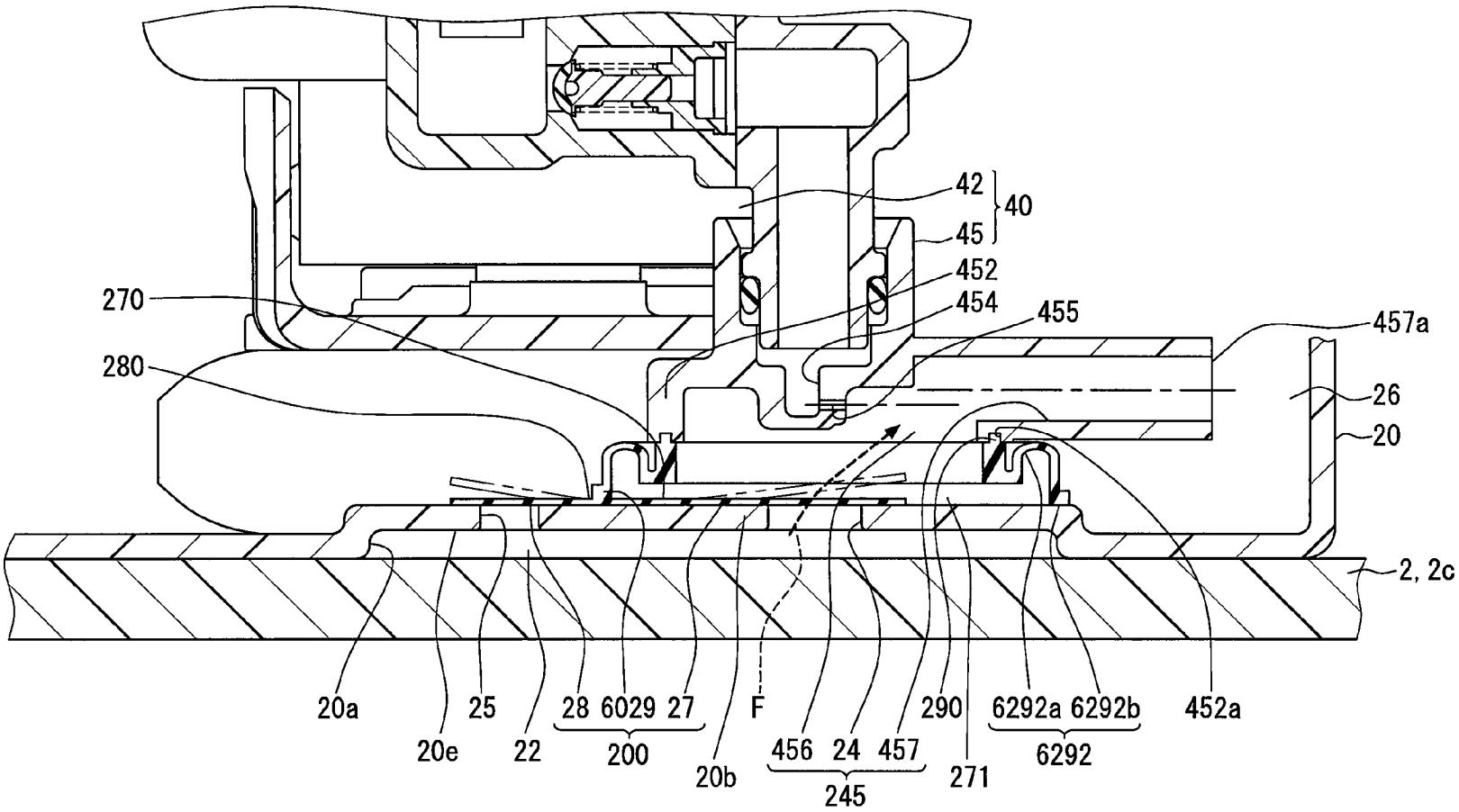
FIG. 11 is a cross-sectional view illustrating a valve structure and a peripheral structure thereof according to a sixth embodiment.

A sixth embodiment of the present disclosure shown in FIG. 11 is a modification example of the fifth embodiment. In the sixth embodiment, a retention element 6029 having an annular shape has a leg portion 6292 which has a different shape from the second embodiment and is formed in a circumferentially continuous manner. A bending portion 6292*a* of the leg portion 6292 is formed at an outer peripheral position of a mounting portion 290 and upwardly bent into a convex arch shape. In addition, a contact surface 6292*b* of the leg portion 6292 is formed in an annular planar shape beneath the bending portion 6292*a* and comes into contact with a recessed bottom portion 20*b* throughout the circumferential direction.

Through such a configuration, the retention element 6029 is arranged between a suction portion 452 and the recessed bottom portion 20*b* and is elastically deformable, and thus seals a gap between the components 452 and 20*b* throughout the circumferential direction in a liquid-tight manner. Here, a contact position of the contact surface 6292*b* on the recessed bottom portion 20*b* outwardly deviates from an inlet 25 while enclosing an outer periphery of an inlet 24. Accordingly, also in the sixth embodiment, the same effects as those described in the first embodiment can be exhibited.

Also in the sixth embodiment, the leg portion 6292 of the retention element 6029 in which a mounting portion 290 is mounted to the suction portion 452 comes into contact with a sub tank bottom portion 20*a* to be elastically deformed. Consequently, reliability of deterioration avoidance effect of pumping efficiency can be enhanced and generation of abnormal noise caused by transfer from a jet pump 45 to the sub tank bottom portion 20*a* can be avoided, through the same principle as the fifth embodiment.

According to the retention element 6029 of the sixth embodiment, since the leg portion 6292 partially bent into the arch shape is easily elastically deformed, a seal function and a vibration transfer suppression function can be increased together between the sub tank bottom portion 20*a* and the suction portion 452. Thereby, both the deterioration avoidance effect of pumping efficiency and the generation avoidance effect of abnormal noise can have high reliability.

Seventh Embodiment

Figure 12:
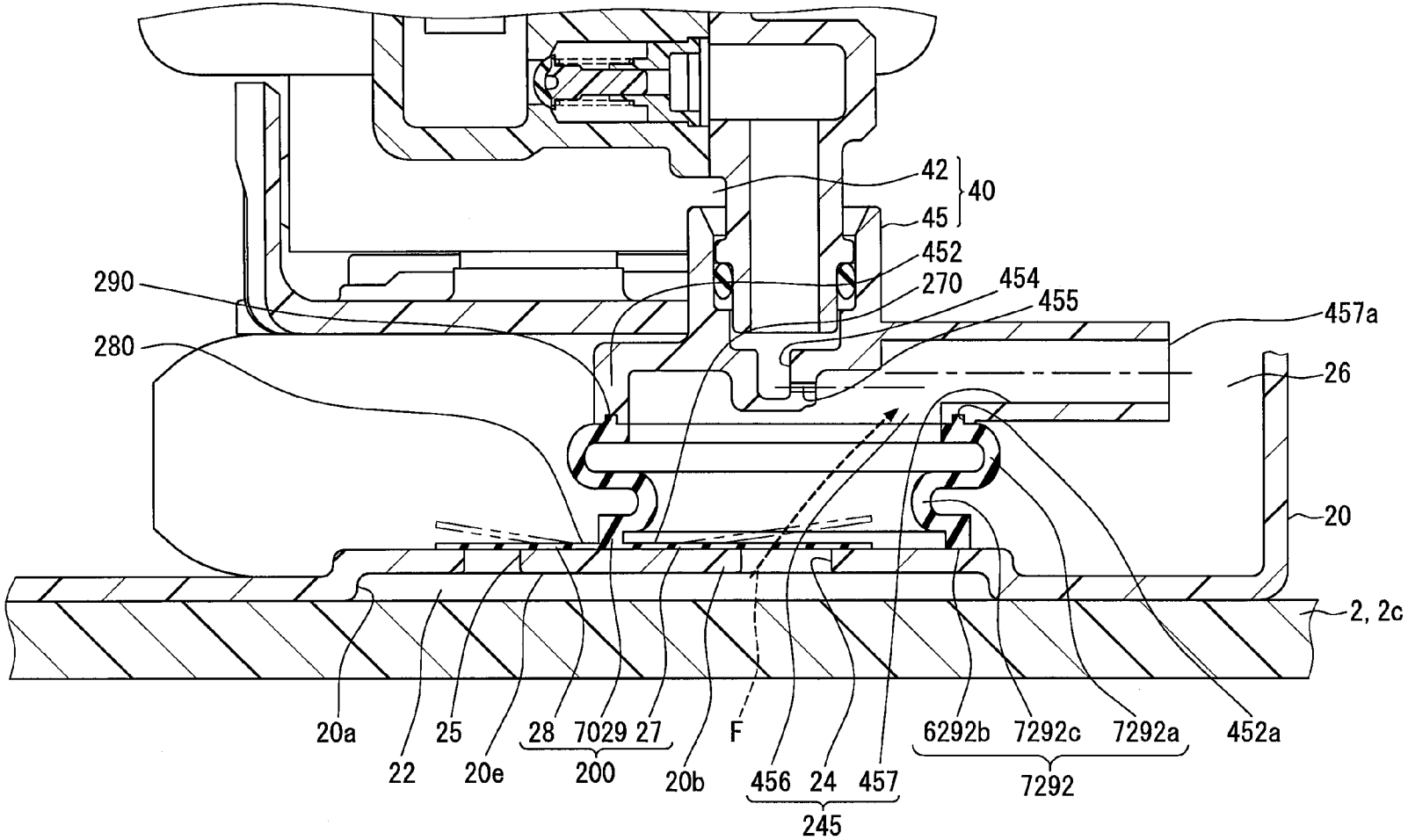
FIG. 12 is a cross-sectional view illustrating a valve structure and a peripheral structure thereof according to a seventh embodiment.

A seventh embodiment of the present disclosure shown in FIG. 12 is a modification example of the sixth embodiment.

In the seventh embodiment, a retention element 7029 having an annular shape has a leg portion 7292 which is bent into a different shape from the sixth embodiment and is formed in a circumferentially continuous manner. A first bending portion 7292*a* of the leg portion 7292 is formed beneath a mounting portion 290 and outwardly bent into a convex arch shape. In addition, a second bending portion 7292*c* of the leg portion 7292 is formed between the first bending portion 7292*a* and a contact surface 6292*b* and inwardly bent into a convex arch shape.

Also in the seventh embodiment through such a configuration, the leg portion 7292, which is bent into the arch shape at a plurality of positions, of the retention element 7029 having the mounting portion 290 that is mounted to a suction portion 452 comes into contact with a sub tank bottom portion 20*a* to be elastically deformed. Accordingly, the same effects as those described in the first and sixth embodiments can be exhibited.

Eighth Embodiment

Figure 13:
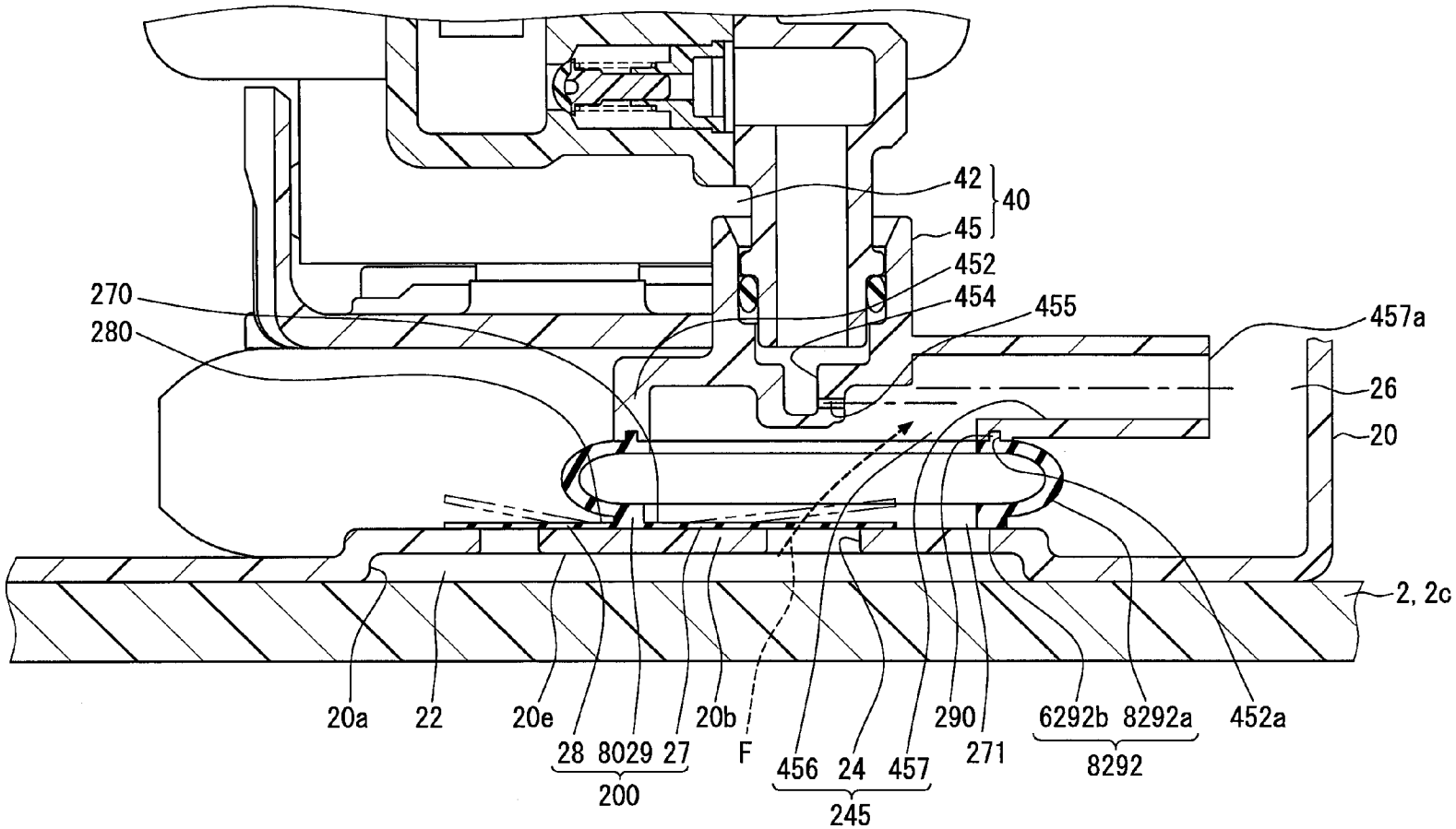
FIG. 13 is a cross-sectional view illustrating a valve structure and a peripheral structure thereof according to an eighth embodiment.

An eighth embodiment of the present disclosure shown in FIG. 13 is a modification of the sixth embodiment. In the eighth embodiment, a retention element 8029 having an annular shape has a leg portion 8292 which is bent into a different shape from the sixth embodiment and is formed in a circumferentially continuous manner. A bending portion 8292*a* of the leg portion 8292 is formed between a mounting portion 290 and a contact surface 6292*b* and outwardly bent into a convex arch shape. It has a convex arch shape.

Also in the eighth embodiment through such a configuration, the leg portion 8292, which is bent into the arch shape as a whole, of the retention element 8029 having the mounting portion 290 that is mounted to a suction portion 452 comes into contact with a sub tank bottom portion 20*a* to be elastically deformed. Accordingly, the same effects as those described in the first and sixth embodiments can be exhibited.

Ninth Embodiment

Figure 14:
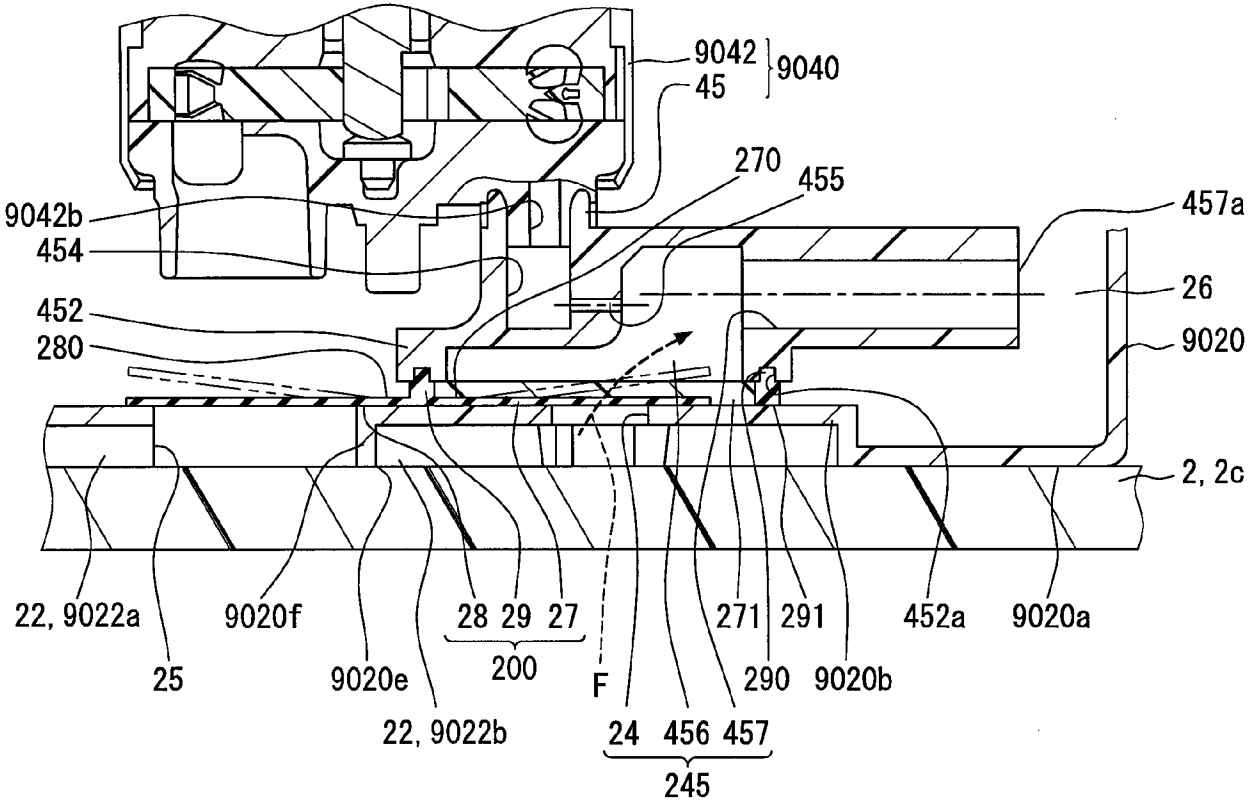
FIG. 14 is a cross-sectional view illustrating a valve structure and a peripheral structure thereof according to a ninth embodiment.

A ninth embodiment of the present disclosure shown in FIG. 14 is a modification of the first embodiment. In a pump unit 9040 of the ninth embodiment, a jet pump 45 is mounted to a lower portion of an electric fuel pump 9042, instead of a lower portion of a port member 44 (not shown). Thereby, pressurized fuel discharged together with vapor from a drain hole 9042*b* in the fuel pump 9042 is guided to a pressurization passage 454, and is thus injected into a diffuser passage 457 from a nozzle passage 455. In addition, a configuration of the pump unit 9040 is substantially identical to that of the pump unit 40 described in the first embodiment, except for being described herein and except that a jet port 441 (not shown) is direct communication with an inner space 26.

In the ninth embodiment, a bottom portion 9020*a* of a sub tank 9020 (hereinafter, referred to as "a sub tank bottom portion 9020*a*") is provided with a partition portion 9020*f* that downwardly protrudes from a recessed bottom portion 9020*b*. The partition portion 9020*f* protrudes to a bottom portion 2*c* of a fuel tank 2 so that an inlet 25 and a portion 9022*a* of an inflow space 22 are isolated from a remaining portion 9022*b* of the inflow space 22. Thereby, the partition portion 9020*f* partitions a gap between lower openings of the respective inlets 25 and 24 on an outer surface 9020*e* of the sub tank bottom portion 9020*a*. With the above configuration, a position of the lower opening of the inlet 25 on the outer surface 9020*e* having a stepped surface shape is lower than that of the lower opening of the inlet 24 on the outer surface 9020*e*. Furthermore, the inlet 25 is in communication with the inside of the fuel tank 2 through a portion 9022*a* of the inflow space 22, whereas the inlet 24 is communication with the inside of the fuel tank 2 through the remaining portion 9022*b* of the inflow space 22. In addition, a configuration of the sub tank 9020 is substantially identical to that of the sub tank 20 described in the first embodiment, except for being described herein.

Also in the ninth embodiment through such a configuration, the same effects as those described in the first embodiment can be exhibited.

As in the ninth embodiment, according to the partition portion 9020*f* which partitions the gap between the openings of the respective inlets 25 and 24 on the outer surface 9020*e* of the sub tank bottom portion 9020*a*, it is difficult for suction force to act on the inlet 25 from the inlet 24 forming a pumping passage 245. Thereby, a reed valve 28 is sucked toward the inlet 25 so that fuel in the sub tank 9020 can be suppressed from leaking. Consequently, the natural inflow of the fuel by allowing the inflow of the fuel into the sub tank 9020 and the storage of the fuel by preventing the outflow of the fuel from the sub tank 9020 can be reliably exhibited as a basic function of the reed valve 28.

According to the ninth embodiment, since the position of the lower opening of the inlet 25 is lower than that of a lower opening of the inlet 24 of the pumping passage 245 on the outer surface 9020*e* of the sub tank bottom portion 9020*a*, the reed valve 28 of the inlet 25 can be opened even by the fuel in the fuel tank 2 having a low liquid level. Thereby, the natural inflow into the sub tank 20 can be reliably realized and thus reliability of the fuel supply device 1 can be increased.

Other Embodiments

Although the plurality of embodiments of the present disclosure have been described, the present disclosure should not be construed as being limited to the embodiments and can be applied to various embodiments and combination thereof without departing from the gist of the disclosure.

Specifically, in a first modification, an auxiliary pump which is provided in front of the fuel pump 42 or 9042 to pump the fuel from the fuel tank 2 to the sub tank 20 or 9020 may also be adopted as "a pump device", in place of the jet pump 45. In a second modification, the pump unit 40 or 9040 may also be adopted as "a housing portion", for example, without provision of the fuel pump 42 or 9042, a portion or the entirety of the filter case 43, a portion or the entirety of the port member 44, etc.

In a third modification, as at least one of "a first valve body" and "a second valve body", for example, a valve having a ball shape or a conical shape, a valve reinforced with a rib, or the like may also be adopted. In a fourth modification, a configuration in which, for example, "a second valve body" such as a reed valve is located at the lowermost downstream end 457*a* of the diffuser passage 457 forming the pumping passage 245 may also be adopted.

Figure 15:
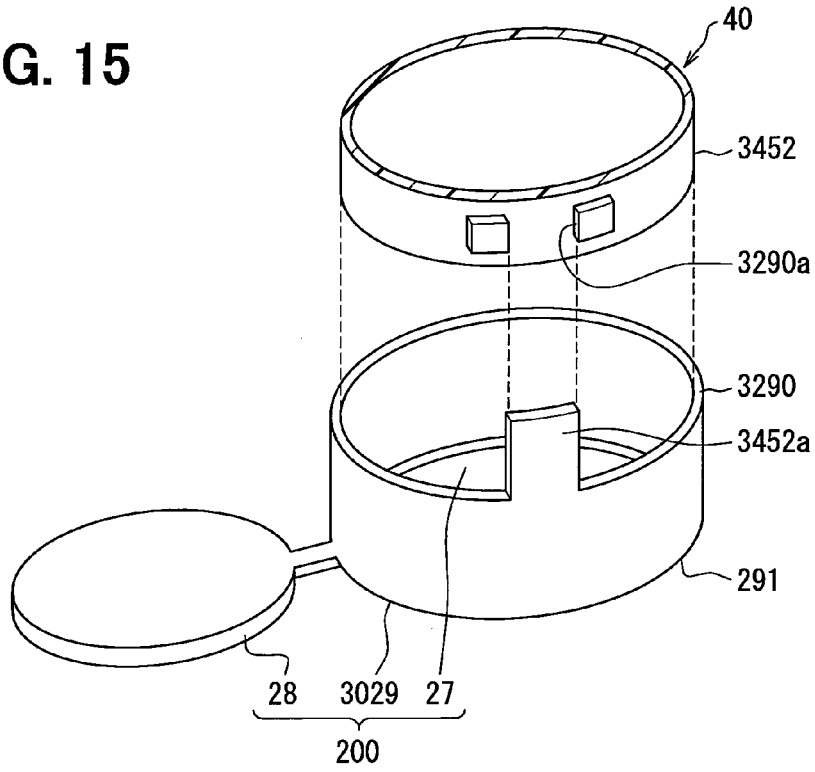
FIG. 15 is a view illustrating a modification of the third embodiment, and corresponds to the perspective view of FIG. 8.
Figure 16:
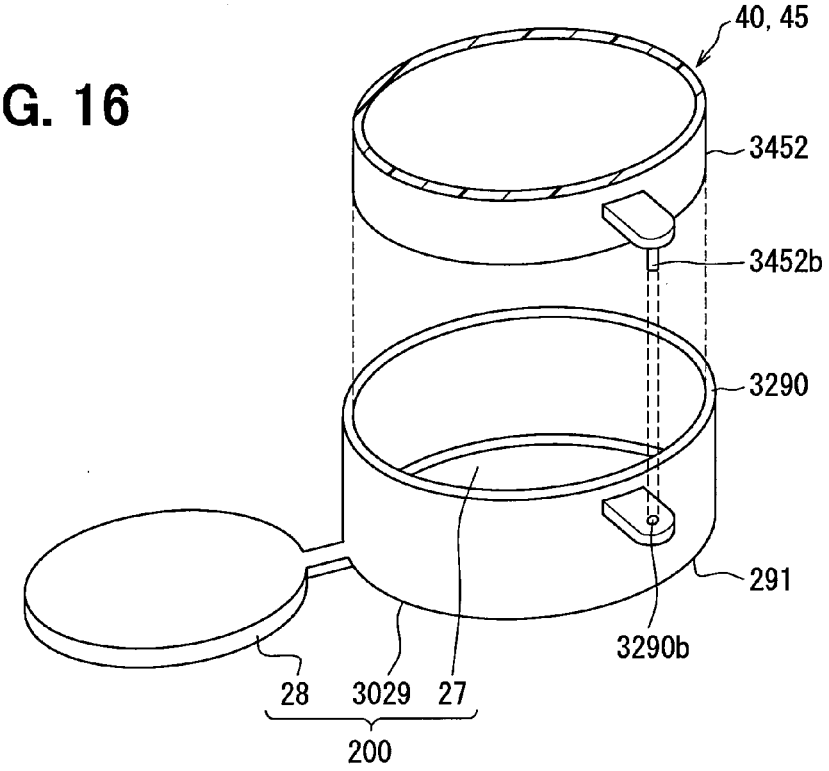
FIG. 16 is a view illustrating a modification of the third embodiment, and corresponds to the perspective view of FIG. 8.

In a fifth modification, a configuration in which the mounting protrusion piece 3452*a* is provided in the mounting portion 3290 as "a rotation stopper" and the mounting slit 3290*a* is provided in the suction portion 3452 may also be adopted, as shown in FIG. 15 regarding the third embodiment. In a sixth modification, the mounting hole 3290*b*, which is provided as "a rotation stopper" in place of the mounting slit 3290*a*, may also be engaged by a mounting rod 3452*b* that is provided in the suction portion 3452, as shown in FIG. 16 regarding the third embodiment.

In a seventh modification, "the rotation stopper" realized by the configuration according to any one of the third embodiment and the fifth and sixth modifications may also be adopted in each of the fifth to ninth embodiments. In an eighth modification, "the rotation stopper" realized by the configuration according to the fourth embodiment may also be adopted in each of the second and fifth to ninth embodiments.

In a ninth modification, any one of the mounting portions 2290, 3290, and 4290 of the second to fourth embodiments may also be adopted in the ninth embodiment. In a tenth modification, a configuration in which the retention element 29, 2029, 3029, 4029, 5029, 6029, 7029, or 8029 is hooked to and retained in the lower portion of the pump unit 40 or 9040, for example, by a claw or the like may also be adopted.

Figure 17:
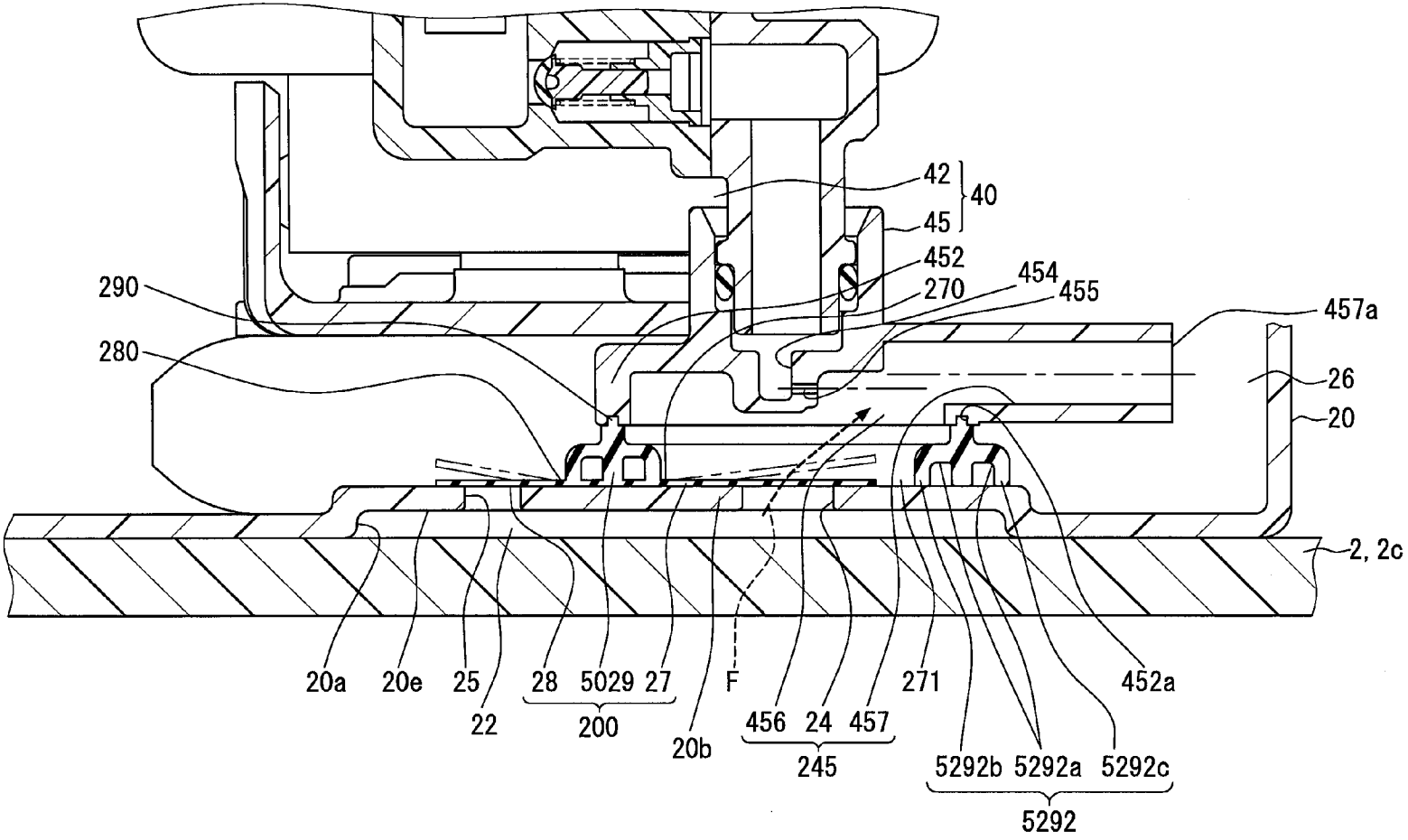
FIG. 17 is a view illustrating a modification of the fifth embodiment, and corresponds to the cross-sectional view of FIG. 10.

In an eleventh modification, as shown in FIG. 17 regarding the fifth embodiment, the leg portion 5292 may also be divided to be a three-pronged or more fork (an example of a three-pronged fork in FIG. 17). In a twelfth modification, any one of the leg portions 5292, 6292, 7292, and 8292 of the fifth to eighth embodiments and the eleventh modification may also be adopted in each of the second to fourth and ninth embodiments.

In a thirteenth modification, the bending portion 6292*a* regarding the sixth embodiment may also be bent downward to have a convex arch shape. In a fourteenth modification, the bending portion 6292*a* regarding the sixth embodiment may also be formed at an inside position of the mounting portion 290.

Figure 18:
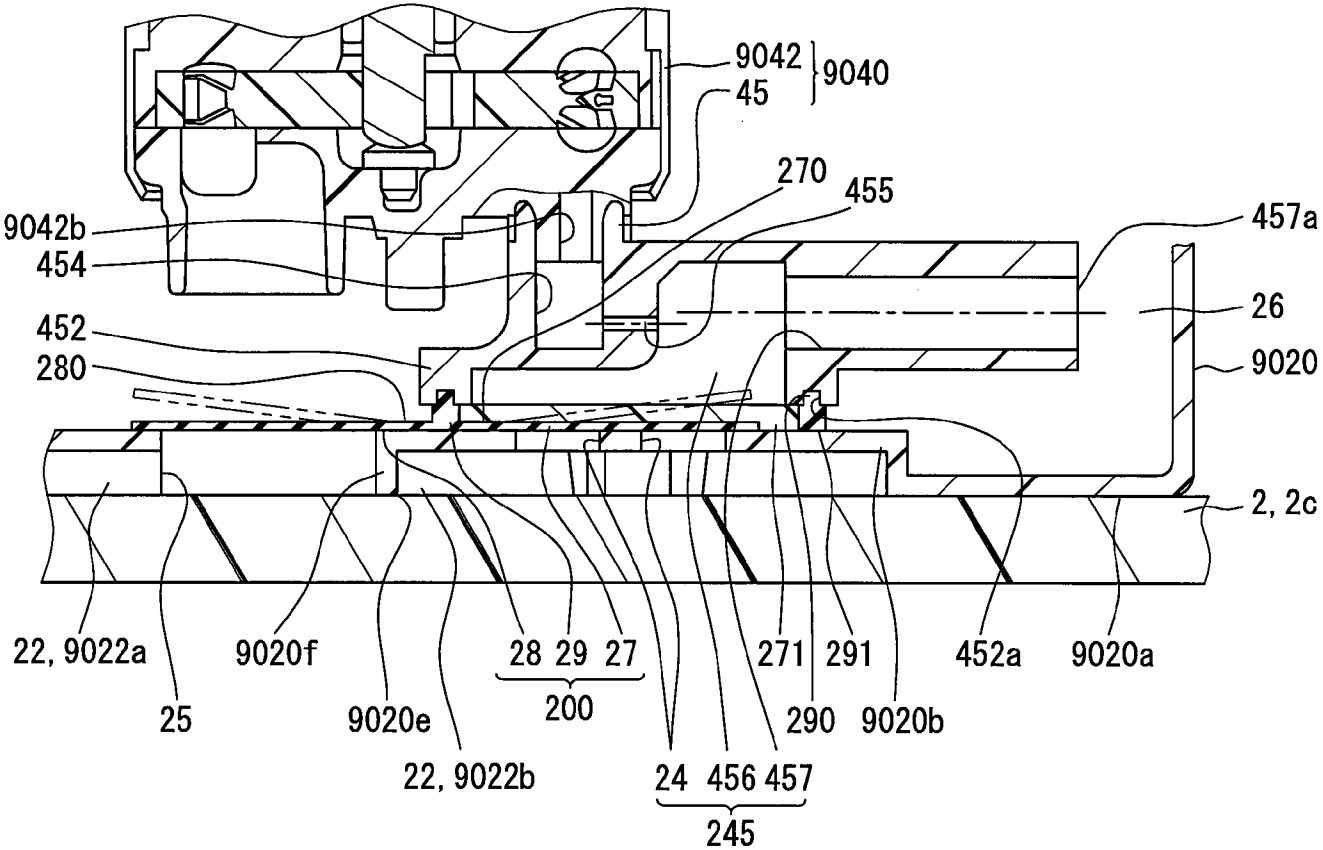
FIG. 18 is a view illustrating a modification of the ninth embodiment, and corresponds to the cross-sectional view of FIG. 14.

In a fifteenth modification, the valve structure 200 may also be made of materials other than rubber. In a sixteenth modification, at least one of the inlets 24 and 25 may also be provided in plural numbers, as shown in FIG. 18. In addition, FIG. 18 shows the fourteenth modification in which the inlet 24 is provided in plural numbers, regarding the ninth embodiment.

In a seventeenth modification, the diffuser passage 457 may not also be upwardly eccentric with respect to the nozzle passage 455. In addition, with respect to the nozzle passage 455 shifted from the upper side of the inlet 24 in a horizontal direction, the diffuser passage 457 may also be eccentric in the horizontal direction, as an eighteenth modification of the seventeenth modification or the first to ninth embodiments in which the diffuser passage 457 is upwardly eccentric with respect to the nozzle passage 455. The pumping efficiency can be increased even by the structure of the eighteenth modification.

What is claimed is:

1. A valve structure located at a bottom portion of a sub tank that is arranged inside a fuel tank, the valve structure allowing an inflow of fuel into the sub tank and preventing an outflow of the fuel from the sub tank, the valve structure comprising:

a retention element that is mounted to and is retained in a lower portion of a stored object, the stored object including a pump device that pumps fuel from the fuel tank into the sub tank through a pumping passage that communicates an inside of the sub tank with an outside of the sub tank, the stored object being inserted from an upper portion of the sub tank and stored housed inside the sub tank;

a first valve body that is integrally formed with the retention element and extends from the retention element, the first valve body being located at a natural inlet open on the bottom portion of the sub tank; and a second valve body that is integrally formed with the retention element and extends from the retention element, the second valve body being located on the pumping passage.

2. The valve structure according to claim 1, wherein the second valve body is located at a pumping inlet that is open on the bottom portion of the sub tank and that is arranged adjacent to the natural inlet, the pumping inlet serving as an upstream end of the pumping passage, the retention element has an annular shape to enclose an outer periphery of the pumping inlet and comes into contact with the bottom portion of the sub tank, the first valve body extends outwardly from an outer periphery of the retention element, and the second valve body extends inwardly from an inner periphery of the retention element.

3. The valve structure according to claim 2, wherein the retention element is arranged between the lower portion of the stored object and the bottom portion of the sub tank to fluidly isolate the natural inlet from the pumping inlet within the sub tank by sealing a gap between the lower portion and the bottom portion.

4. The valve structure according to claim 1, wherein the second valve body is located at a pumping inlet that is open on the bottom portion of the sub tank, the pumping inlet serving as an upstream end of the pumping passage, and the retention element is arranged between the bottom portion of the sub tank and a passage member that serves as a portion of the pumping passage downstream of the pumping inlet in the pump device, the retention element sealing a gap between the passage member and the bottom portion.

5. The valve structure according to claim 4, wherein the retention element includes a mounting portion that is mounted to the passage member, and a leg portion that comes into contact with the bottom portion of the sub tank, the leg portion being elastically deformable.

6. The valve structure according to claim 5, wherein the leg portion is divided into a forked shape by a recessed groove.

7. The valve structure according to claim 5, wherein the leg portion has at least a portion that has an arch shape.

8. The valve structure according to claim 4, wherein the retention element has an annular shape and comes into contact with the bottom portion of the sub tank at a position around the pumping inlet, and the second valve body extends inwardly from an inner periphery of the retention element.

9. The valve structure according to claim 8, wherein the retention element has a rotation stopper that regulates rotation of the retention element by being engaged by the passage member.

10. The valve structure according to claim 4, wherein the retention element is made of rubber and integrally formed with the first and second valve bodies.

11. The valve structure according to claim 1, wherein the retention element is mounted to the lower portion of the stored object by being press-fitted into the lower portion.

12. The valve structure according to claim 1, wherein the retention element is mounted to the lower portion of the stored object by press-fitting the lower portion into the retention element.

13. The valve structure according to claim 1, wherein the second valve body extends along a flow direction of fuel inside the pumping passage, and a connection portion between the retention element and the second valve body is arranged at an upstream position in the flow direction.

14. The valve structure according to claim 1, wherein the first and second valve bodies are a plate-shaped reed valve that swings about a connection portion that is connected to the retention element.

15. A fuel supply device comprising:

a sub tank that is arranged inside a fuel tank;

a stored object that includes a pump device, the pump device pumping fuel from the fuel tank into the sub tank through a pumping passage that communicates an inside of the sub tank with an outside of the sub tank, the stored object being inserted from an upper portion of the sub tank and housed inside the sub tank; and a valve structure that is located at a bottom portion of the sub tank, the valve structure allowing an inflow of the fuel into the sub tank and preventing an outflow of the fuel from the sub tank, wherein the valve structure includes:

a retention element that is mounted to and is retained in a lower portion of the stored object;

a first valve body that is integrally formed with the retention element and extends from the retention element, the first valve body being located at a natural inlet that is open on the bottom portion of the sub tank; and a second valve body that is integrally formed with the retention element and extends from the retention element, the second valve body being located on the pumping passage.

16. The fuel supply device according to claim 15, wherein the second valve body is located at a pumping inlet that is open on the bottom portion of the sub tank and that is arranged adjacent to the natural inlet, the pumping inlet serving as an upstream end of the pumping passage, the retention element has an annular shape to enclose an outer periphery of the pumping inlet and comes into contact with the bottom portion of the sub tank, the first valve body extends outwardly from an outer periphery of the retention element, and the second valve body extends inwardly from an inner periphery of the retention element.

17. The fuel supply device according to claim 16, wherein the retention element is arranged between the lower portion of the stored object and the bottom portion of the sub tank to fluidly isolate the natural inlet from the pumping inlet within the sub tank by sealing a gap between the lower portion and the bottom portion.

18. The fuel supply device according to claim 15, wherein a gap between openings of the natural inlet and the pumping passage, which are open on an outer surface of the bottom portion of the sub tank, is partitioned by a partition portion.

19. The fuel supply device according to claim 15, wherein an opening position of the natural inlet on an outer surface of the bottom portion of the sub tank is lower than an opening position of the pumping passage on the outer surface.

20. The fuel supply device according to claim 15, wherein the pump device is a jet pump that generates a fuel flow inside the pumping passage by injecting fuel into the pumping passage.

21. The fuel supply device according to claim 20, wherein the second valve body is located at a pumping inlet that is open on the bottom portion of the sub tank, the pumping inlet serving as an upstream end of the pumping passage, the jet pump has a passage member that serves as a portion of the pumping passage downstream of the pumping inlet, the passage member covers the pumping inlet, and the retention element is arranged between the passage member and the bottom portion of the sub tank to seal a gap between the passage member and the bottom portion.

22. The fuel supply device according to claim 20, wherein the second valve body is located at a pumping inlet that is open on the bottom portion of the sub tank, the pumping inlet serving as an upstream end of the pumping passage, and the jet pump includes:

a nozzle passage from which fuel is injected into the pumping passage;

a suction passage that is formed in the pumping passage at a position downstream of the pumping inlet; and a diffuser passage that is formed in the pumping passage downstream of the suction passage and that is upwardly eccentric with respect to the nozzle passage, the diffuser passage allowing fuel that is sucked into the suction passage from the pumping inlet, which is opened by the second valve body, to be pumped into the sub tank through the lower suction passage by a negative pressure that is generated according to fuel injection from the nozzle passage.

23. The fuel supply device according to claim 15, wherein the stored object is a pump unit that includes an electric fuel pump, the electric fuel pump supplying fuel inside the sub tank to an outside of the fuel tank.

* * * * *